US006994511B2

(12) United States Patent
Westendorf et al.

(10) Patent No.: US 6,994,511 B2
(45) Date of Patent: Feb. 7, 2006

(54) LOADER ASSEMBLY, COMBINATION MOTOR VEHICLE AND LOADER ASSEMBLY, HYDRAULIC CYLINDERS AND METHODS FOR OPERATING A LOADER ASSEMBLY

(75) Inventors: Neal W. Westendorf, Dakota Dunes, SD (US); Joseph W. Langenfeld, Onawa, IA (US)

(73) Assignee: Westendorf Manufacturing Co., Inc., Onawa, IA (US)

( * ) Notice: Subject to any disclaimer, the term of this patent is extended or adjusted under 35 U.S.C. 154(b) by 45 days.

(21) Appl. No.: 10/719,677

(22) Filed: Nov. 21, 2003

(65) Prior Publication Data

US 2005/0111953 A1 May 26, 2005

(51) Int. Cl.
*E02F 3/627* (2006.01)

(52) U.S. Cl. ..... 414/686; 414/918

(58) Field of Classification Search ..... 414/686, 414/918; 172/272–275
See application file for complete search history.

(56) References Cited

U.S. PATENT DOCUMENTS

| | | | |
|---|---|---|---|
| 2,326,338 A | | 3/1943 | Drott et al. |
| 2,812,595 A | | 11/1957 | Drott et al. |
| 3,077,999 A | | 2/1963 | Svoboda |
| 3,209,474 A | | 10/1965 | Artman |
| 3,243,905 A | | 4/1966 | Ulrich |
| 3,344,540 A | | 10/1967 | Ulrich |
| 3,455,477 A | | 7/1969 | Blair |
| 3,512,665 A | | 5/1970 | Westendorf |
| 3,701,443 A | | 10/1972 | Lely |
| 3,982,643 A | * | 9/1976 | MacGregor et al. .... 172/273 X |
| 3,991,890 A | | 11/1976 | Frank |
| 4,033,469 A | | 7/1977 | Frank |
| 4,051,962 A | | 10/1977 | Westendorf |
| 4,085,856 A | | 4/1978 | Westendorf |
| 4,345,870 A | | 8/1982 | Anderson et al. |
| 4,538,955 A | | 9/1985 | Langenfeld et al. |
| 4,565,485 A | | 1/1986 | Wilman |
| 4,566,844 A | | 1/1986 | Campin |
| 4,606,692 A | | 8/1986 | Langenfeld et al. |
| 4,787,811 A | | 11/1988 | Langenfeld et al. |
| 4,790,084 A | | 12/1988 | Anderson et al. |
| 4,797,051 A | | 1/1989 | Langenfeld et al. |

(Continued)

OTHER PUBLICATIONS

"Kubota Diesel Tractor", Catalog No. 3079-01-US, 12 Pages, Feb. 1990.

(Continued)

*Primary Examiner*—Donald W. Underwood
(74) *Attorney, Agent, or Firm*—Merchant & Gould P.C.

(57) ABSTRACT

A loader assembly is provided according to the invention. The loader assembly includes a boom arm and a bracket assembly. The boom arm includes a tower that includes a plurality of first hydraulic fluid coupler members, a lift arm that rotates relative to the tower about a tower/lift arm rotating pin, and at least one hydraulic cylinder. The bracket assembly includes a stationary bracket that includes a plurality of second hydraulic fluid coupler members. The stationary bracket is constructed for attachment to a motor vehicle and attachment to the tower to provide a fluid connection between the first coupler members and the second coupler members. The rotating bracket rotates relative to the stationary bracket about a bracket rotation pin. The rotating bracket is constructed to receive the tower and rotate the tower for attachment to the stationary bracket. A combination motor vehicle and loader assembly, and methods for operating a loader assembly are provided. Hydraulic cylinders that are ported at one end are also provided.

25 Claims, 16 Drawing Sheets

U.S. PATENT DOCUMENTS

| | | | | | |
|---|---|---|---|---|---|
| 4,798,511 | A | * | 1/1989 | Kaczmarczyk et al. | 414/686 |
| 4,859,130 | A | | 8/1989 | Langenfeld et al. | |
| 4,890,400 | A | | 1/1990 | Long | |
| 4,915,575 | A | | 4/1990 | Langenfeld et al. | |
| 4,930,974 | A | | 6/1990 | Langenfeld et al. | |
| 4,968,213 | A | | 11/1990 | Langenfeld et al. | |
| 4,995,760 | A | | 2/1991 | Probst et al. | |
| 5,121,557 | A | | 6/1992 | Moore | |
| 5,232,330 | A | * | 8/1993 | Rae et al. | 414/686 |
| 5,387,076 | A | | 2/1995 | Fuzzen | |
| 5,466,113 | A | | 11/1995 | Norberg | |
| 5,785,328 | A | | 7/1998 | Eckloff | |
| 5,997,237 | A | | 12/1999 | Langenfeld et al. | |
| 6,142,724 | A | | 11/2000 | Hirooka et al. | |
| 6,582,177 | B1 | | 6/2003 | Westendorf et al. | |
| 6,663,337 | B2 | | 12/2003 | Westendorf et al. | |

OTHER PUBLICATIONS

"Bush Hog Front End Loaders", 12 Pages, Date Unknown.
"Bush Hog QT Series Front End Loaders", 16 Pages, Date Unknown.

* cited by examiner 28
85
42
60
78
77
80
70
43
58
41
40

85
78
76
74
71
80
89
91

83
78
85
74
89
91
43

85
78
56
70
43
58
90

LOADER ASSEMBLY, COMBINATION MOTOR VEHICLE AND LOADER ASSEMBLY, HYDRAULIC CYLINDERS AND METHODS FOR OPERATING A LOADER ASSEMBLY

FIELD OF THE INVENTION

The invention relates to a loader assembly, a combination motor vehicle and loader assembly, hydraulic cylinders, and methods for operating a loader assembly. The loader assembly provides for convenient attachment and detachment from a motor vehicle, and for concealing hydraulic lines to reduce snagging and/or damaging the hydraulic lines and to provide enhanced protection of the hydraulic lines.

BACKGROUND OF THE INVENTION

Conventional front-end loaders have a pair of boom assemblies that have rearward ends that pivotally attach to a tractor, and forward ends that pivotally attach to an attachment. Exemplary attachments found conventional front end loaders include buckets, clam shells, plows, fork lifts, bale spears, etc. Hydraulic cylinders are provided for operating the front-end loaders and the attachments. Hydraulic lines can be found extending along the exterior of the front-end loaders for powering the hydraulic cylinders. In addition, when attaching front-end loaders to a tractor, it is often necessary to separately and manually connect the hydraulic lines on the front end loader to the hydraulic lines on the tractor.

Exemplary front end loaders are described by U.S. Pat. No. 3,512,665 to Westendorf; U.S. Pat. No. 4,085,856 to Westendorf; U.S. Pat. No. 4,787,811 to Langenfeld et al.; U.S. Pat. No. 4,051,962 to Westendorf; U.S. Pat. No. 4,606,692 to Langenfeld et al.; and U.S. Pat. No. 4,930,974 to Langenfeld et al.

SUMMARY OF THE INVENTION

A loader assembly is provided according to the invention. The loader assembly includes a boom arm and a bracket assembly. The boom arm includes a tower that includes a plurality of first hydraulic fluid coupler members, a lift arm that rotates relative to the tower about a tower/lift arm rotating pin, and at least one hydraulic cylinder. The bracket assembly includes a stationary bracket and a rotating bracket. The stationary bracket includes a plurality of second hydraulic fluid coupler members. The stationary bracket is constructed for attachment to a motor vehicle and attachment to the tower to provide a fluid connection between the first coupler members and the second coupler members. The rotating bracket rotates relative to the stationary bracket about a bracket rotation pin. The rotating bracket is constructed to receive the tower and rotate the tower for attachment to the stationary bracket.

A loader assembly is provided according to the invention including a left boom arm, a right boom arm, at least one stabilizing arm, and hydraulic lines. The left boom arm includes a left tower, a left lift arm constructed to rotate relative to the left tower about a left tower/left lift arm rotation pin, and a left lift cylinder attached to the left tower and the left lift arm to cause the left lift arm to rotate relative to the left tower. The right boom arm includes a right tower, a right lift arm constructed to rotate relative to the right tower about a right tower/right lift arm rotation pin, and a right lift cylinder attached to the right tower and the right lift arm to cause the right lift arm to rotate relative to the right tower. The stabilizing arm is provided extending between the left lift arm and the right lift arm and includes an interior region. Additional stabilizing arms can be provided extending between the left lift arm and the right lift arm. The hydraulic lines are provided extending through the interior region of the stabilizing arm. In addition, the left lift arm can be provided including an interior region, the right lift arm can be provided having an interior region, and the hydraulic lines can be provided extending through the interior region of the left lift arm and the interior region of the right lift arm. In this manner, the hydraulic lines can be considered concealed or internal to the loader assembly when they are not extending along the exterior of the loader assembly. The hydraulic lines that pass through the stabilizing arm can be provided for powering the left lift cylinder and the right lift cylinder. In addition, the loader assembly can include a left attachment cylinder and a right attachment cylinder, and the hydraulic lines extending through the stabilizing arm can be provided for powering the left attachment cylinder and the right attachment cylinder.

A combination motor vehicle and loader assembly is provided according to the invention. The combination motor vehicle and loader assembly includes a motor vehicle having a forward end, and a loader assembly attached to the motor vehicle forward end. The loader assembly includes a boom arm and a bracket assembly. The boom arm includes a tower having a plurality of first hydraulic fluid coupler members, a lift arm that rotates relative to the tower about a tower/lift arm rotating pin, and at least one hydraulic cylinder. The bracket assembly includes a stationary bracket and a rotating bracket. The stationary bracket is attached to the motor vehicle forward end, and the stationary bracket includes a plurality of second hydraulic fluid coupler members attached to the first hydraulic fluid coupler members to provide a fluid connection between the first hydraulic fluid coupler members and the second hydraulic fluid coupler members. The rotating bracket rotates relative to the stationary bracket about a bracket rotation pin and is constructed to receive the tower and rotate the tower for attachment to the stationary bracket.

Methods for operating a loader assembly are provided according to the invention. The methods for operating a loader assembly include methods for attaching the loader assembly to a motor vehicle and methods for detaching a loader assembly from a motor vehicle. The method for attaching a loader assembly to a motor vehicle includes steps of providing a loader assembly in a storage position and moving the motor vehicle forward so that the loader assembly attaches to the motor vehicle. The loader assembly includes a boom arm having a tower that includes a plurality of first hydraulic fluid coupler members. The loader assembly additionally includes a bracket assembly provided on the motor vehicle. The bracket assembly includes a stationary bracket and a rotating bracket. The stationary bracket includes a plurality of second hydraulic fluid coupler members. By moving the motor vehicle forward, the plurality of first hydraulic fluid coupler members and the plurality of second hydraulic fluid coupler members can attach together as a result of attaching the boom arm to the bracket assembly. The method for attaching a loader assembly to a motor vehicle can include attachment of the hydraulic lines without a separate step of manually connecting hydraulic lines. That is, the hydraulic lines can be attached as a result of attaching the boom arm to the bracket assembly without an additional step of independently attaching the hydraulic lines. In addition, the loader assembly can include a stand that supports it in the storage position. The operator can rotate the bucket in order to cause the stand to become retracted into the boom arm. The method of detaching the loader assembly can include steps of providing the loader assembly in a storage position, releasing a catch that allows the tower to separate from the bracket assembly, and backing the motor vehicle away from the loader assembly. The loader assembly can be provided in the storage position by the motor vehicle operator releasing a stand that supports the loader assembly in the storage position. The operator can release the stand and/or retract the stand without leaving the operator's area of the motor vehicle.

Several hydraulic cylinder designs are provided according to the invention. The hydraulic cylinder designs can be referred to as "single ported end hydraulic cylinders" because the ports for the hydraulic fluid are provided at one end of the hydraulic cylinders. Accordingly, the hydraulic cylinders can be used as the lift cylinders and/or the attachment cylinders in the loader assembly. By providing the ports at one end of the hydraulic cylinders, stresses on the hydraulic lines can be reduced and the length of hydraulic lines can be reduced when the lines are provided within the loader assembly.

DETAILED DESCRIPTION OF THE INVENTION

Figure 1:
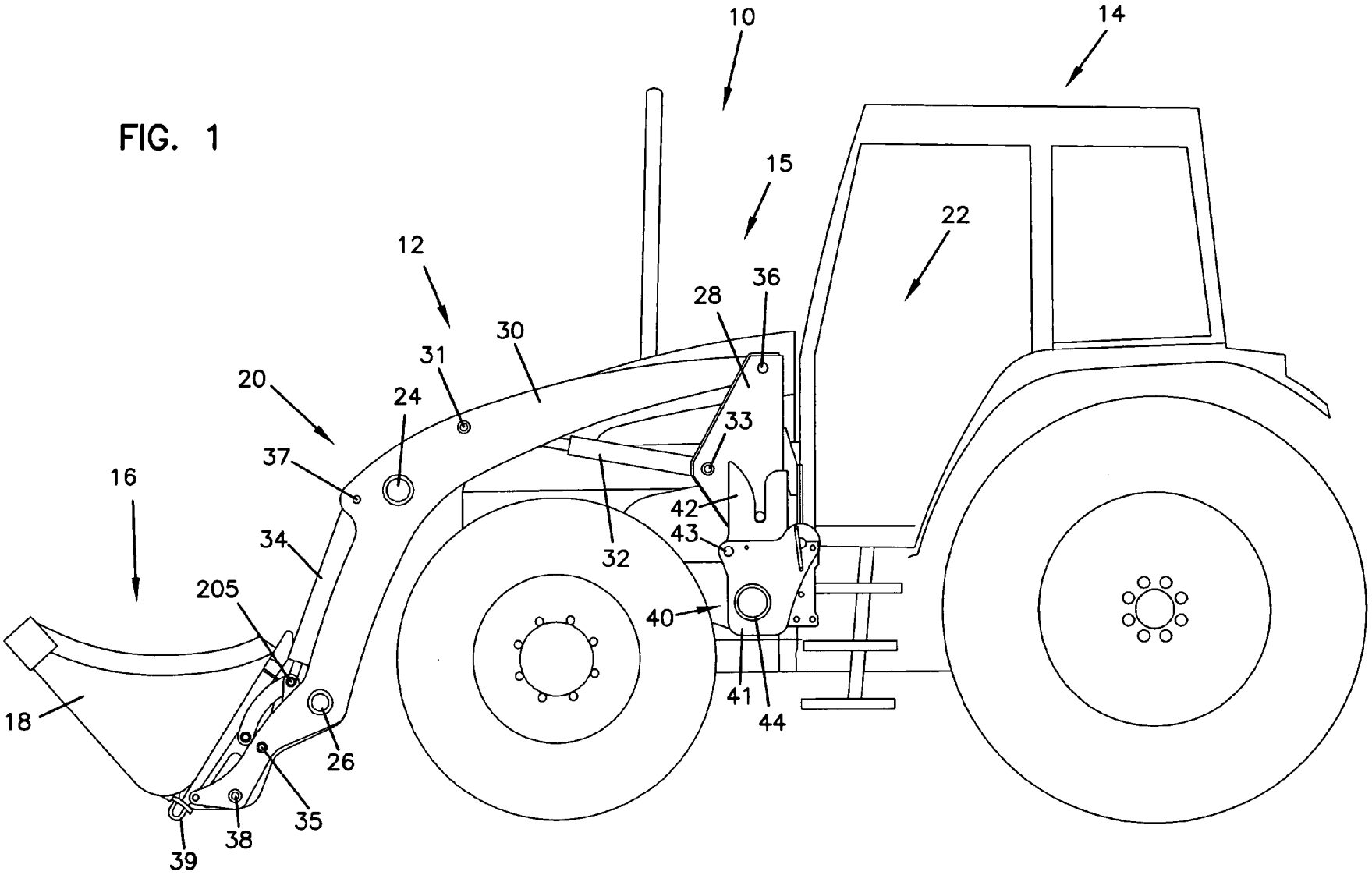
FIG. 1 is a side view of a tractor and loader assembly according to the principles of the present invention.

A combination motor vehicle and loader assembly is shown in FIGS. 1–8 at reference numeral 10. The combination motor vehicle and loader assembly 10 is shown as a loader assembly 12 attached to a tractor 14. It should be understood that the loader assembly 12 can be provided on motor vehicles other than tractors. Exemplary other vehicles that can be used with the loader assembly 12 include trucks and converted combines.

The loader assembly 12 is shown attached to the front end 15 of the tractor 14, and can be referred to as a front-end loader. The loader assembly 12 can include an attachment 16. The attachment 16 shown is a bucket 18. Exemplary other attachments that can be provided on the loader assembly 12 include a clam shell, a plow, a fork lift, a bale spear, etc.

The loader assembly 12 includes a left boom arm 20 and a right boom arm (not shown). In general, the structure of the left and right boom arms can be similar. Because the structure of the right boom arm can be similar to the structure of the left boom arm 20, the following discussion focuses on the left boom arm 20 and it should be understood that the structure applies to the right boom arm unless indicated differently. The left boom arm 20 attaches at the left side of the tractor 14. It is pointed out that the right boom arm (not shown) attaches at the right side of the tractor 14. The reference to a left side and a right side are based upon the orientation of a driver sitting in the operator's area 22. In general, it is expected that the left and right boom arms operate together. For the loader assembly 12, the left and right boom arms are attached together by the stabilizing arms 24 and 26. The boom arms can additionally attach together via the tractor 14 and the attachment 16. In general, the left boom arm and the right boom arm can be characterized as having corresponding structure. For example, the structure of the right boom arm can be similar to the structure of the left boom arm. A loader assembly having a left boom arm and a right boom arm is shown in U.S. application Ser. No. 10/719,657 that was filed with the United States Patent and Trademark Office on Nov. 21, 2003, the entire disclosure of which is incorporated herein by reference.

The left boom arm 20 includes a tower 28, a lift arm 30, a lift cylinder 32, and an attachment cylinder 34. These structures can be provided on the right boom arm. The lift cylinder 32 causes the lift arm 30 to rotate about the tower 28 at the tower/lift arm rotation pin 36. The lift cylinder 32 attaches to the lift arm 30 at the lift cylinder first rotation pin 31, and to the tower 28 at the lift cylinder second rotation pin 33. The attachment cylinder 34 causes the attachment 16 to rotate relative to the lift arm 30 about the attachment/lift arm pin 38. The attachment cylinder 34 attaches to the attachment 16 via the attachment cylinder first rotation pin 35, and to the lift arm 30 at the attachment cylinder second rotation pin 37. The attachment cylinder 34 can attach directly to an attachment or to an attachment connection device 39 as shown in FIG. 1. Exemplary attachment devices can be referred to as "quick attachment devices." Exemplary quick attachment devices are described in U.S. Pat. No. 3,512,665 to Westendorf, U.S. Pat. No. 4,085,856 to Westendorf, U.S. Pat. No. 4,787,811 to Langenfeld et al., U.S. Pat. No. 4,859,130 to Langenfeld et al., U.S. Pat. No. 4,915,575 to Langenfeld et al., and U.S. Pat. No. 4,968,213 to Langenfeld et al. The disclosures of quick attachment devices provided in these patents are incorporated herein by reference.

The loader assembly 12 is operated by the movement of the lift cylinder 32 and the attachment cylinder 34. Extending the lift cylinder 32 raises the attachment 16, and retracting the lift cylinder 32 lowers the attachment 16. Extending and contracting the attachment cylinder 34 causes the attachment 16 to rotate. In general, it is expected that the left boom arm and the right boom arm will operate together. Accordingly, the lift cylinders provided on the left boom arm and the right boom arm can extend or contract together, and the attachment cylinders provided on the left boom arm and the right boom arm can extend or contract together. It should be understood that either the left boom arm or the right boom arm can be referred to as the "boom arm" and the components of the boom arm can be characterized without the designation left or right. In addition, the term "corresponding" can be used to refer to the other boom arm or components thereof. Of course, it should be understood that the characterization of the loader assembly can refer to a boom arm without identifying the corresponding boom arm because it is believed that the loader assembly can be provided with a single boom arm or with multiple (such as two) boom arms.

The attachment cylinder 34 can provide for operation of various attachments and in various manners. The attachment cylinder 34 can provide operations other than rotation of the attachment. For example, when the attachment is a bale spear such as the bale spear described in U.S. application Ser. No. 09/778,673 that was filed with the United States Patent and Trademark Office on Feb. 7, 2001, the attachment cylinder can provide for operation of the bale spear. The disclosure of the bale spear of U.S. application Ser. No. 09/778,673 is incorporated herein by reference.

The loader assembly 12 additionally includes a bracket assembly 40 that includes a stationary bracket 41 and a rotating bracket 42. The stationary bracket 41 attaches to the tractor 14. The rotating bracket 42 rotates relative to the stationary bracket 41 about the bracket rotating pin 43. The bracket assembly 40 can be referred to as the left bracket assembly. A right bracket assembly can be provided on the right side of the tractor 14. A bracket arm 44 can be provided to assist in the attachment of the stationary bracket 41 to the tractor 14. The left boom arm 20 attaches to the left bracket assembly 40, and the right boom arm (not shown) attaches to the right bracket assembly (not shown).

Figure 2:
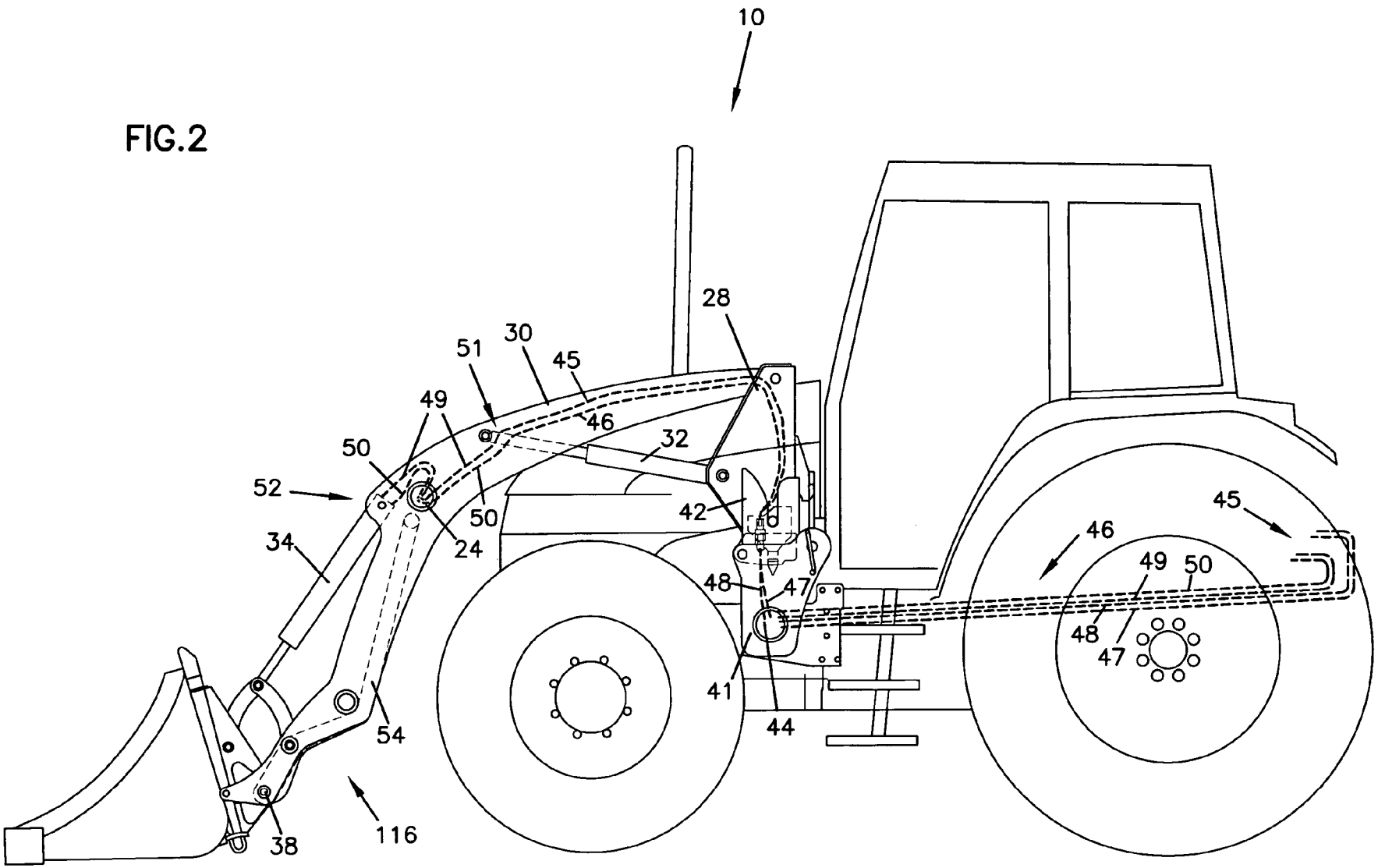
FIG. 2 is a side view of the tractor and loader assembly of FIG. 1 wherein an exemplary placement of the hydraulic lines is illustrated.

Now referring to FIG. 2, the combination motor vehicle and loader assembly 10 can be constructed so that the hydraulic lines 46 that operate the lift cylinders and the attachment cylinders are concealed. That is, they are hidden from view and protected. Prior front end loaders have hydraulic lines that extend along the exterior of the front end loader. Because the hydraulic lines are exposed, they have a tendency to collect debris, such as branches, and may become pinched or snagged. By concealing the hydraulic lines within the loader assembly 12 according to the invention, it is possible to protect the hydraulic lines from damage. In addition, concealing the hydraulic lines provides an aesthetically pleasing look. Concealing the hydraulic lines within the loader assembly can result in a loader assembly that is more convenient to attach and detach from a motor vehicle.

The hydraulic lines 46 can be concealed within the loader assembly 12. By being concealed within the loader assembly 12, it is meant that there are no hydraulic lines that extend exterior to the loader assembly 12. It should be understood that the tower 28 and the loader arm 30 are enclosed structures. That is, the tower 28 and the lift arm 30 include an interior area through which the hydraulic lines 46 can extend. There are openings into the interior area of the tower 28 and the lift arm 30 through which the lift cylinder 32 and the attachment cylinder 34 extend. Accordingly, it should be understood that the reference to concealing the hydraulic lines 46 is not meant to imply that it is impossible to see the hydraulic lines if one looks into one of the openings. Instead, it is meant that there are not hydraulic lines extending along the outside of the loader assembly. An additional advantage of concealing the hydraulic lines within the loader assembly is that stresses on the lines can be reduced when the hydraulic cylinders operate compared with several prior designs.

FIG. 2 includes a representative flow path for the hydraulic lines 46 through the combination motor vehicle and loader assembly 10. There are various ways in which the hydraulic lines 46 can be arranged so that they remain concealed and are available for operating the hydraulic cylinders. The representative flow path shown in FIG. 2 is an exemplary flow path and may be altered depending upon the motor vehicle design and possible alternative loader assembly designs. As shown in FIG. 2, the hydraulic lines 46 extend from hydraulic ports 45 on the tractor 14, through the tractor 14, through the loader assembly 12, and eventually to the lift cylinders and the attachment cylinders.

In order to operate four hydraulic cylinders, where two lift cylinders are operated in parallel and two attachment cylinders are operated in parallel, the hydraulic ports on the tractor 14 provides for at least four lines. Two of the lines operate both of the lift cylinders, and two of the lines operate both of the attachment cylinders. Additional lines can be provided from the hydraulic ports to operate additional hydraulic equipment such as hydraulic cylinders or some other type of hydraulically operated system on an attachment or elsewhere on the tractor. For a hydraulic cylinder, one line provides for extension of the hydraulic cylinder and can be referred to as an extension line, and the other line provides for retraction of the hydraulic cylinder and can be referred to as a retraction line. The applicants have found that it is convenient to have two of the hydraulic lines enter the loader assembly 12 by entering through the left bracket assembly 40 and have two of the lines entering the loader assembly 12 through the right bracket assembly (not shown). Once the lines enter the left and right bracket assemblies, they extend through the left and right towers and the left and right boom arms. The applicants have found that it is convenient to have the hydraulic lines communicate between the left boom arm and the right boom arm by traveling through the stabilizing arm 24.

For the hydraulic line configuration shown in FIG. 2, the hydraulic lines 46 extend from the hydraulic ports 45 to the left and right bracket assemblies. It should be understood that the hydraulic lines 46 extend through the tractor 14 in a manner that is convenient for concealment. The representation of the hydraulic lines 46 through the tractor 14 in FIG. 2 is for illustrative purposes. The lines extending to the left bracket assembly 40 include the lift cylinder extension line 47 and the lift cylinder retraction line 48. The lift cylinder extension line 47 and the lift cylinder retraction line 48 pass through the left bracket assembly 40 and into the tower 28 and through the lift arm 30. The lift cylinder extension line 47 and the lift cylinder retraction line 48 pass through the left lift cylinder 32 and continue through the stabilizing arm 24 to power the right lift cylinder (not shown). The left lift cylinder 32 incorporates a tee connection therein that splits the lift cylinder extension line 47 and the lift cylinder retraction line 48 to operate both the left lift cylinder and the right lift cylinder. The attachment cylinder extension line 49 and the attachment cylinder retraction line 50 extend through the right bracket assembly (not shown), the right tower (not shown), the right lift arm (not shown), the right attachment cylinder (not shown), and then through the stabilizing arm 24 for powering the left attachment cylinder 34.

It should be understood that the illustration of the hydraulic lines 46 in FIG. 2 is an exemplary characterization of how the hydraulic lines 46 can be concealed. It should be understood that alternative arrangements of the hydraulic lines can be provided for concealing the hydraulic lines within the loader assembly 12. For example, the lift cylinder extension line and the lift cylinder retraction line can be provided extending through the right bracket assembly, and the attachment cylinder extension line and the attachment cylinder retraction line can be provided extending through the left bracket assembly. In addition, tees can be provided for splitting the lines. In the case of the lift cylinder 32, the lift cylinder 32 acts as a tee for allowing the lift cylinder extension line 47 and the lift cylinder retraction line 48 to pass to the right lift cylinder.

In order to operate four hydraulic cylinders where sets of two hydraulic cylinders are operated simultaneously, at least four hydraulic cylinder lines can be provided. Two hydraulic lines are provided for powering the pair of lift cylinders and two hydraulic lines are provided for powering the pair of attachment cylinders. By providing conduits for running hydraulic lines from the left boom arm to the right boom arm, it is possible to arrange the hydraulic lines in any number of ways to provide the desired operation of the hydraulic cylinders.

To help conceal the hydraulic lines 46, the lift cylinders and the attachment cylinders can be constructed so they are each ported at one end. That is, the lift cylinder 32 includes a ported end 51 and the attachment cylinder 34 includes a ported end 52. The ported ends 51 and 52 attach to the hydraulic lines 46. By porting the hydraulic cylinders at one end, it is possible to avoid having a hydraulic line extend outside of the loader assembly in order to port the other end of the hydraulic cylinder. In addition, porting the cylinders at one end can help reduce stress on the hoses used to form the hydraulic lines. It is expected that the hoses will wear longer by reducing stresses.

Attachment/Detachment of the Loader Assembly

Figure 3:
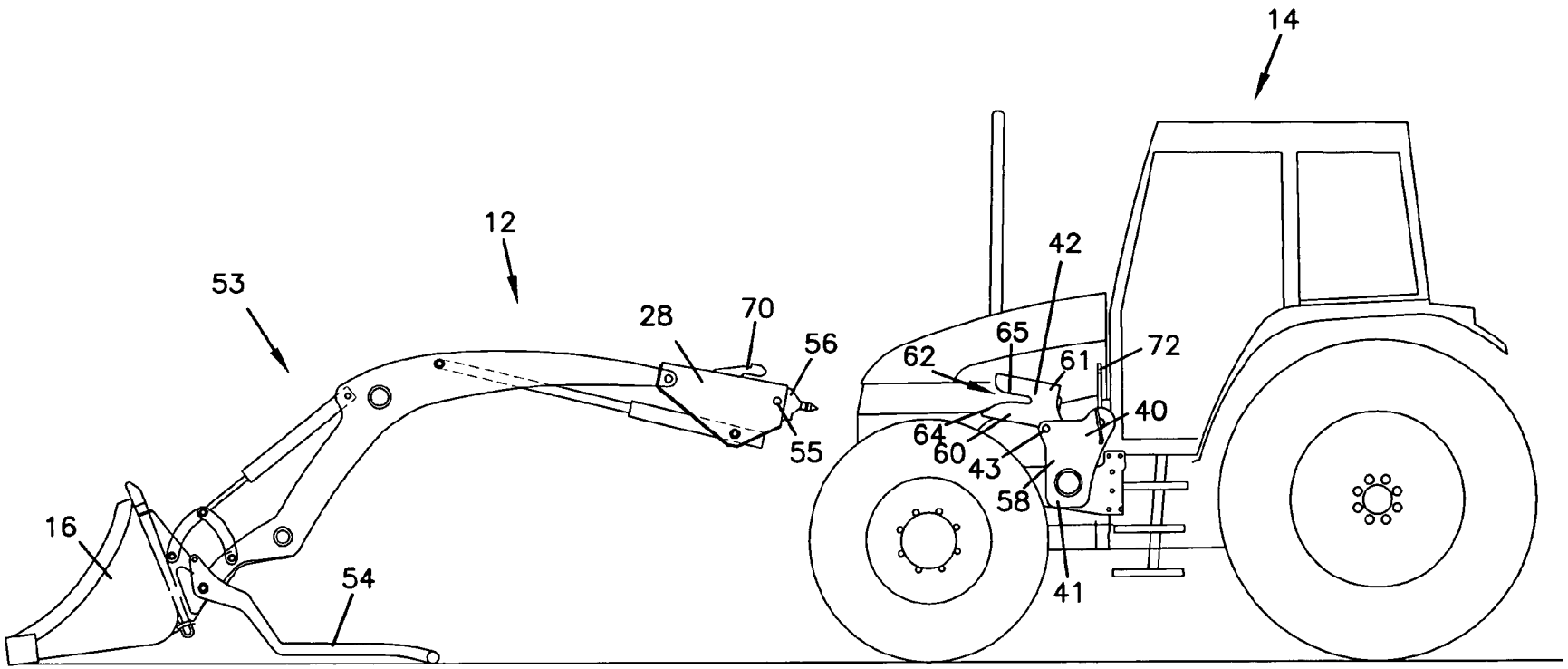
FIG. 3 is a side view showing a loader assembly detached from a tractor according to the principles of the invention.

The loader assembly 12 can be attached to and detached from the tractor 14 by moving the tractor 14 toward or away from the loader assembly 12. As shown in FIG. 3, the loader assembly 12 and the attachment 16 can be provided in a storage position 53. The loader positioner 54 supports the loader assembly 12 in the storage position 53 so that the tower 28 is in a position available to engage the bracket assembly 40. The tower 28 includes a guide pin 55 and an upper nesting block 56. The guide pin 55 can be provided extending from the sides of the tower 28. The bracket assembly 40 includes a stationary bracket 41 and a rotating bracket 42 that rotates relative to the stationary bracket 41 about the bracket rotation pin 43. The stationary bracket 41 includes a lower nesting block nesting block 58 that is configured to receive the upper nesting block 56. The rotating bracket 42 includes a receiver 60 that has sides and an internal space for receipt of the tower 28. The left side 61 and the right side (not shown) include guide pin slots 62 for receipt of the guide pin 55 that extends from opposed sides of the tower 28. The guide pin slot 62 includes guide surfaces 64 and 65 that are expected to first contact the guide pin 55 and guide it into the guide pin slot 62.

Figure 4:
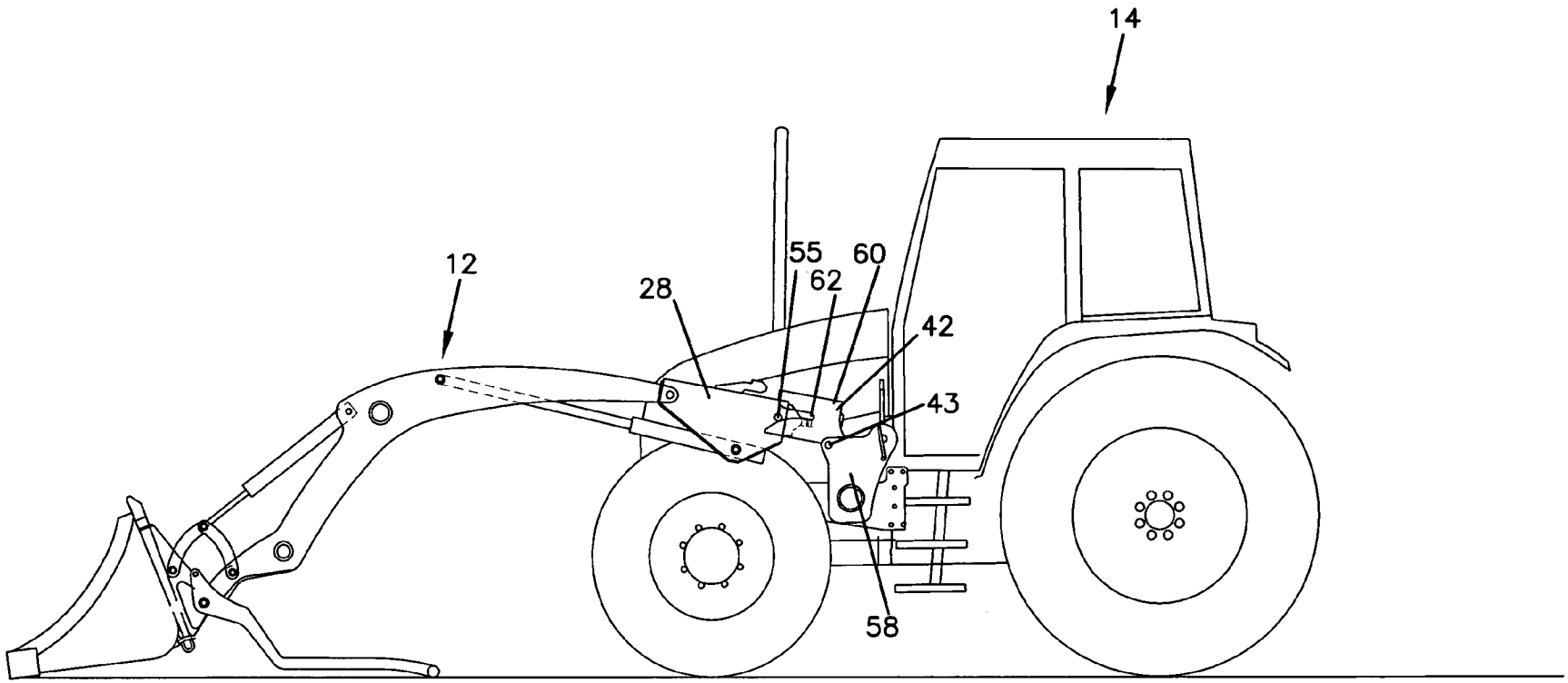
FIG. 4 is a side view showing a loader assembly contacting a tractor according to the principles of the invention.
Figure 5:
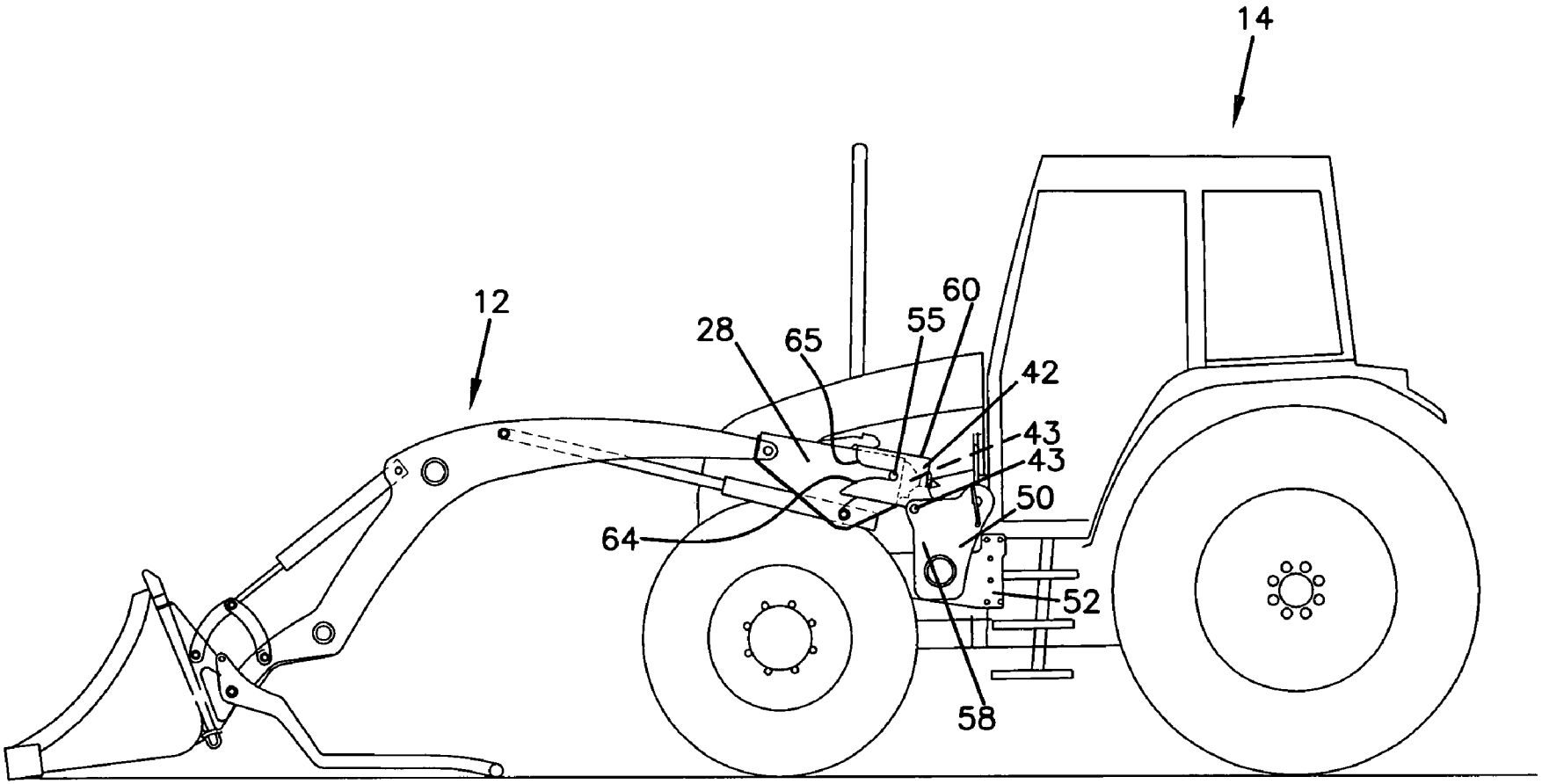
FIG. 5 is a side view showing a loader assembly contacting a tractor according to the principles of the invention.

Now referring to FIGS. 4 and 5, as the tractor 14 approaches the loader assembly 12, the driver should steer the tractor so that the tower 28 becomes received within the receiver 60. It is expected that the height of the tower 28 off of the ground, when provided in the storage position 53, will be provided sufficient to engage the receiver 60. Accordingly, the driver should take care that the tower 28 will be between the left wall 61 and the right wall (not shown) of the receiver 60. It is expected that the height of the tower will adjust itself to a certain extent as the guide pin 55 engages one of the guide surfaces 64 and 65. As the tractor 12 continues forward, the guide pin 55 continues to enter the guide pin slot 62 until the tower 28 is fully received within the receiver 60. As the tractor 14 continues forward, the rotating bracket 42 begins rotating about the bracket rotating pin 43 until the upper nesting block 56 and the lower nesting block 58 are engaged.

Figures 6A, 6B, 6C, 6D:
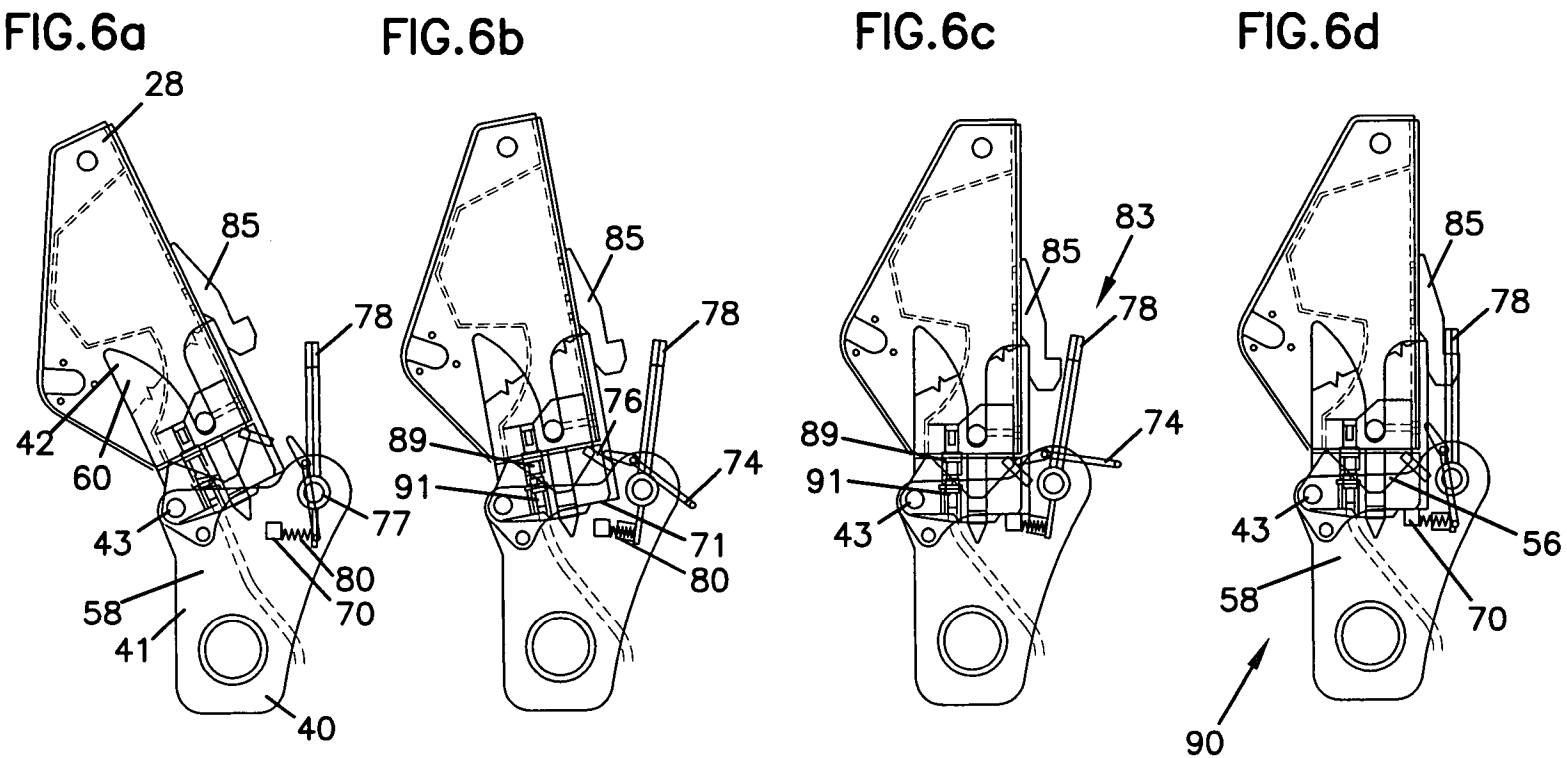
FIGS. 6(*a*)–(*d*) are side views showing the tower of a loader assembly attaching to the bracket assembly of a tractor according to the principles of the invention.

Now referring to FIGS. 6(*a*)–(*d*), the rotation of the rotating bracket 42 including the tower 28, relative to the stationary bracket 41 is shown. As shown in FIG. 6(*a*), the tower 28 is fully engaged within the receiver 60. The receiver 60, containing the tower 28, rotates about the bracket rotating pin 43 until the upper nesting block 56 is engaged with the lower nesting block 58 as shown in FIG. 6(*d*). To prevent or reduce the occurrence of over-rotation, the stationary bracket 41 can include a stop 70. The stop 70 can be located so that the receiver bottom surface 71 does not rotate beyond the stop 70.

As the receiver 60, containing the tower 28, continues to rotate about the bracket rotation pin 43, the receiver hook 85 moves the catch 78 to rotate on pin 77. This movement is a result of compression of the compression spring 80. As the receiver 60 and the tower 28 continue to rotate to the stop 70, the catch 78 engages over the hook 85 to fully mount the loader 12 onto the tractor 14. As a result of the catch 78 extending over the receiver hook 85, the rotating bracket 42 is unable to rotate relative to the stationary bracket 41.

When it is desired to remove the loader assembly 12 from the tractor 14, the lever arm 74 can be rotated so that the catch 78 is moved to the retracted position 83 thereby releasing the receiver hook 85. When the catch 78 is provided in the retracted position 83, the rotating bracket 42 is then able to rotate relative to the stationary bracket 41 about the rotation pin 43. This action also resets the catch 78 when tab 76 contacts lever 74 and rotates so the spring 80 moves the catch 78 to the locking position for remounting the loader.

By attaching the upper nesting block 56 to the lower nesting block 58, the hydraulic lines attach there through. That is, the upper nesting block 56 includes hydraulic couplers 89 that engage hydraulic couplers 91 in the lower nesting block 58. By simply driving the tractor 14 forward, it is possible to attach the loader assembly 12 to the tractor 14 without leaving the operator area 22.

Figure 8:
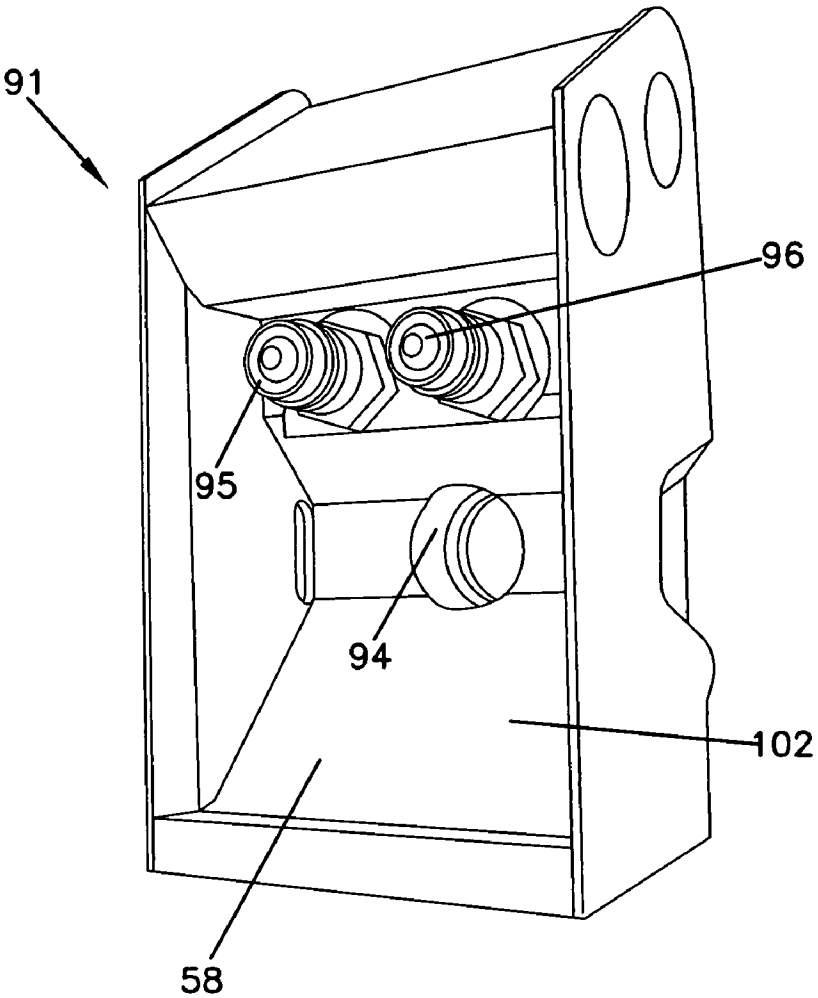
FIG. 8 is an isolated, perspective view of a lower nesting block according to the principles of the invention.
Figure 7:
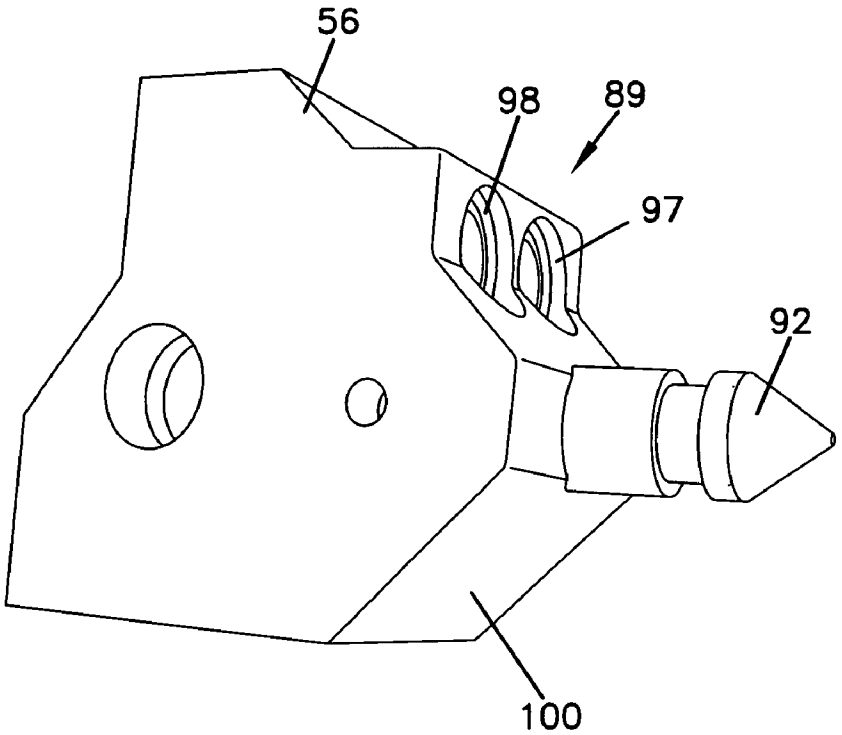
FIG. 7 is an isolated, perspective view of an upper nesting block according to the principles of the invention.

Now referring to FIGS. 7 and 8, the upper nesting block 56 and the lower nesting block 58 are shown. The upper nesting block 56 and the lower nesting block 58 can be combined or nested together, and the resulting structure can be referred to as a hydraulic line manifold assembly 90 as shown in FIG. 6(*d*) because it provides for the connection between the hydraulic lines extending from the hydraulic pump and the hydraulic lines extending from the hydraulic cylinders.

In FIG. 7, the upper nesting block 56 is shown in isolation. The upper nesting block 56 fits within the tower 28. In FIG. 8, the lower nesting block 58 is shown in isolation. The lower nesting block 58 fits within the rotating bracket 42. As the upper nesting block 56 rotates into the lower nesting block 58, the centering pin 92 in the upper nesting block 56 engages the centering pin receiving hole 94 in the lower nesting block 58 so that the hydraulic line couplers 95 and 96 engage the corresponding hydraulic line couplers 97 and 98. Once the centering pin 92 is fully received within the centering pin hole 94, the upper nesting block 56 is engaged with the lower nesting block 58 and the hydraulic lines are attached.

Attaching the upper nesting block 56 to the lower nesting block 58 creates a connection between two hydraulic cylinder lines 47 and 48 shown in FIG. 2. Hydraulic cylinder lines 49 and 50 can be connected by attachment of the right tower to the right bracket assembly. By attaching the front end loader 12 to the tractor 14, the hydraulic lines automatically attach and there is no need for manual attachment when the bracket assembly includes the hydraulic line manifold assembly 90. Several conventionally available front end loaders require a separate manual connection for the hydraulic lines that occurs either before or after the front end loader is attached to the tractor. The front end loader according to the invention can provide for automatic attachment of the hydraulic lines as a result of attaching the loader assembly to the motor vehicle.

The centering pin 92 and the centering pin hole 94 are provided to help align the upper nesting block 56 and the lower nesting block 58. It should be understood that alternative designs can be provided to align the upper nesting block 56 and the lower nesting block 58 so that the hydraulic line couplers 95 and 96 to engage the corresponding hydraulic line couplers 97 and 98, respectively. The couplers 95 and 96 and the couplers 97 and 98 can be considered mating couplers. The hydraulic line couplers 95 and 96 can be considered male couplers and are provided secured to the lower nesting block 58. The hydraulic line couplers 97 and 98 can be considered female couplers and are provided within the upper nesting block 56. It should be understood that the location of the couplers can be reversed. That is, the male couplers can be provided in the upper nesting block and the female couplers can be provided in the lower nesting block. In addition, the couplers can be mixed so that a male coupler and a female coupler are provided in the upper nesting block and the corresponding couplers are provided in the lower nesting block. Additional couplers can be provided when it is desirable to include additional hydraulically driver apparatuses. Hydraulic line couplers that can be used according to the invention are commercially available.

The upper nesting block 56 includes a contoured engaging surface 100, and the lower nesting block 58 includes a contoured engaging surface 102. The contoured engaging surfaces 100 and 102 are configured so that the surfaces nest in a three dimensional arrangement. The contoured engaging surfaces 100 and 102 are provided to resist a twisting motion between the upper nesting block 56 and the lower nesting block 58. It is expected that the operation of the front end loader 12 will place tremendous twisting and/or bending moments on the connection between the upper nesting block 56 and the lower nesting block 58. Accordingly, the engaging surfaces 100 and 102 are configured to resist those twisting and/or bending moments. By maintaining a secure connection between the upper nesting block 56 and the lower nesting block 58, the hydraulic cylinder lines remain connected.

Figure 9:
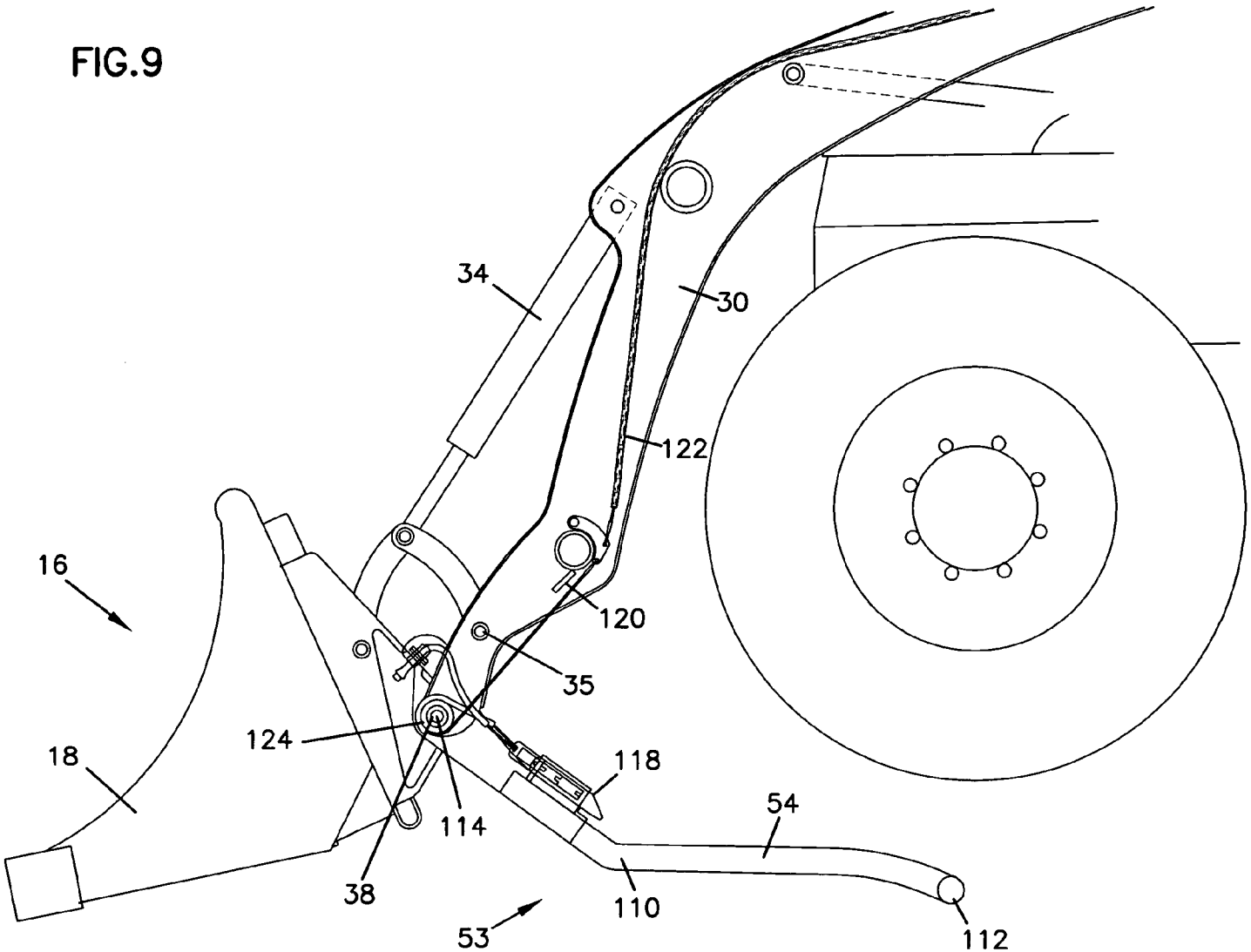
FIG. 9 is a side view of the loader assembly in a storage position according to the principles of the invention.
Figure 10:
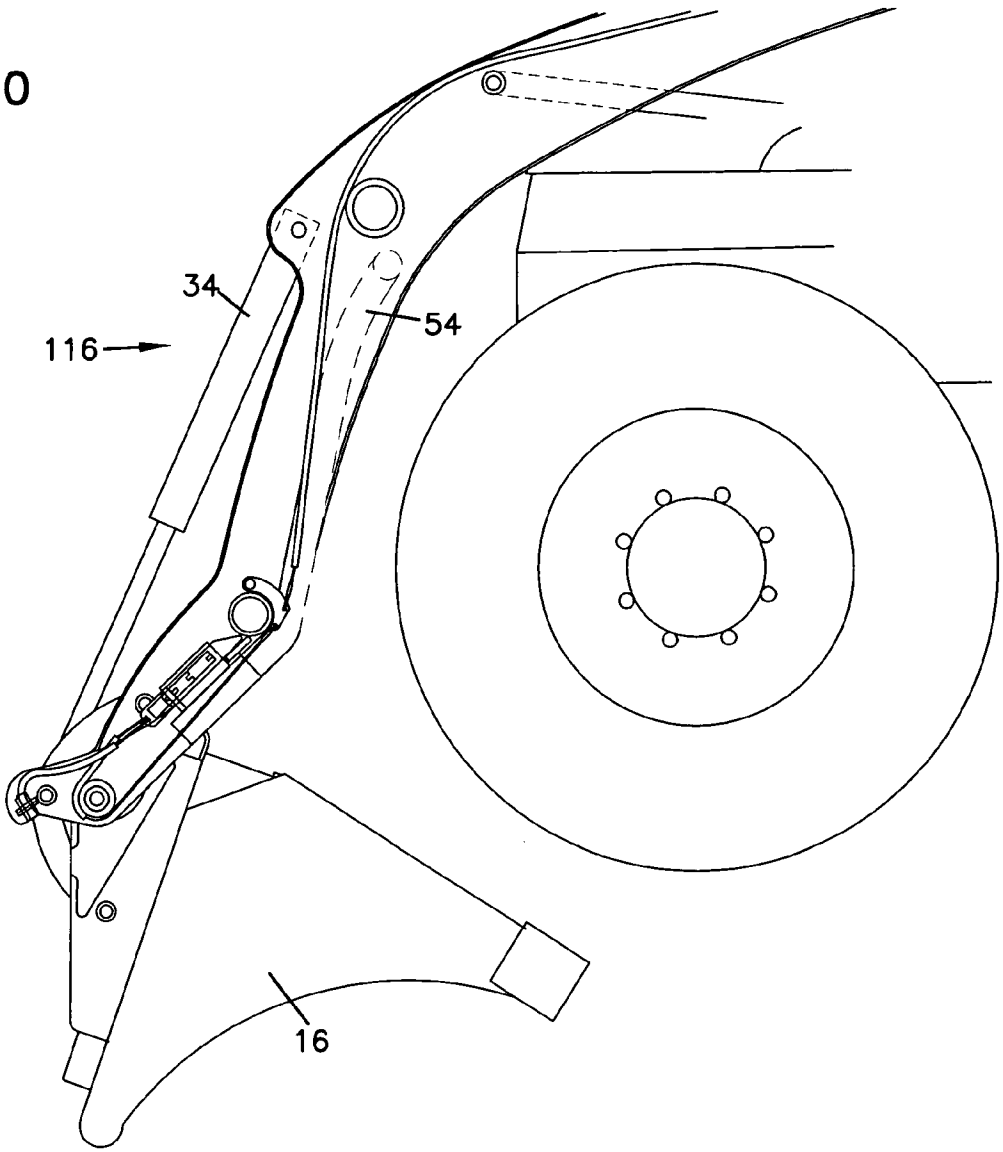
FIG. 10 is a side view of the loader assembly in a working position according to the principles of the invention.

Now referring to FIGS. 9 and 10, the operation of the loader positioner or stand 54 is shown. The loader positioner 54 includes a left positioner arm 110, a right positioner arm (not shown) and a cross member 112 that extends between the left positioner arm and the right positioner arm. The left positioner arm 110 extends from the lift arm 30 and rotates about the loader positioner rotation pin 114. The right positioner arm (not shown) can be similarly attached to the right lift arm (not shown) for rotation about a right loader positioner rotation pin (not shown).

The loader assembly 12 can be characterized as being in a storage position 53 when the loader positioner 54 is extended as shown in FIGS. 3 and 9. When the loader positioner 54 is retracted as shown in FIGS. 1, 2, and 10, the loader assembly 12 can be characterized as being in a working position 116. The loader positioner 54 can move between the extended and retracted positions. When the loader positioner 54 is in the extended position, the loader positioner 54 is used to support the loader assembly so that it can be attached/detached from the tractor. When the loader assembly is in use, the loader positioner 54 is provided in the retracted position and can be fitted into the lift arm 30 so that it does not interfere with the operation of the loader assembly.

The loader positioner 54 includes a spring-loaded catch 118 located along the positioner arm 110 that engages a lock bar 120. The catch 118 moves in and out so that it locks itself in place relative to the lock bar 120. A cable 122 can be strung from the operator area 22 to the catch 118. When the operator pulls the cable 122, the catch 118 can be retracted so that the loader positioner 54 moves to the extended position. The loader positioner 54 rotates around pin 114 to the extended position. The loader positioner 54 can be retracted by extending the attachment cylinder 34 so that the attachment 16 pushes the loader positioner 54 into the lift arm 30. The catch 118 retracts and then engages the lock bar 120.

Before the loader assembly 12 is detached from the tractor 14, the operator can pull the cable 122 to release the loader positioner 54 so that it extends. Once the catch 78 is released from the hook 85, the operator can simply move the tractor 14 backward to disengage from the loader assembly 12.

As shown in FIG. 10, the bucket 16 is capable of a wide range of rotation about the attachment/lift arm pin 38. One reason for this is the lift arm 30 includes a rotation end 126. In general, the lift arm 30 can include a separate member called the rotation end 126 provided at the end of the lift arm 30 that provides for extending forward both the attachment/lift arm pin 36 and the attachment cylinder first rotation pin 35. In addition, the rotation end 126 includes a clearance 127 that allows the bucket 18 to rotate further backward as shown in FIG. 10.

Hydraulic Cylinders

Hydraulic cylinders are provided that are ported at one end. These hydraulic cylinders can be referred to as "single ported end hydraulic cylinders." In order to help conceal the hydraulic lines 46, it can be desirable to port the hydraulic cylinders at one end in order to avoid having hydraulic lines extend through or outside of the loader assembly 12 to port both ends of the hydraulic cylinder. Accordingly, by providing a hydraulic cylinder that is ported at one end and not the other, it is possible to remove the need to extend hydraulic lines to both sides of the hydraulic cylinder. Various designs of single ported end hydraulic cylinders are provided. It should be understood that any of these hydraulic cylinders can be used to provide the lift hydraulic cylinder and/or the attachment hydraulic cylinder. In addition, it should be understood that conventional hydraulic cylinders that are ported at both ends can be used in the loader assembly according to the invention if one is willing to extend the hydraulic lines to both ends of the hydraulic cylinder.

Figure 11:
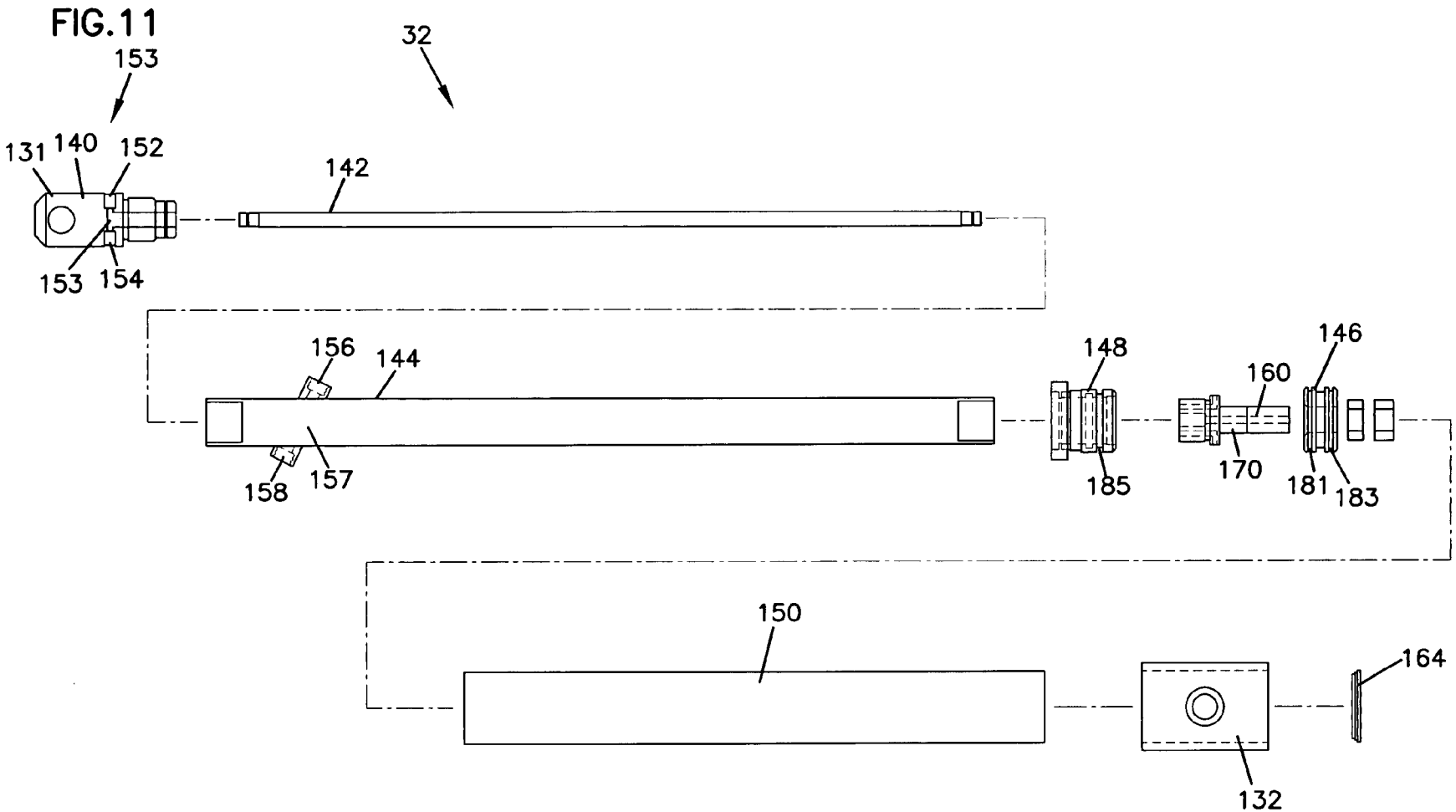
FIG. 11 is an assembly view of the lift cylinder shown in FIG. 1.
Figure 12:
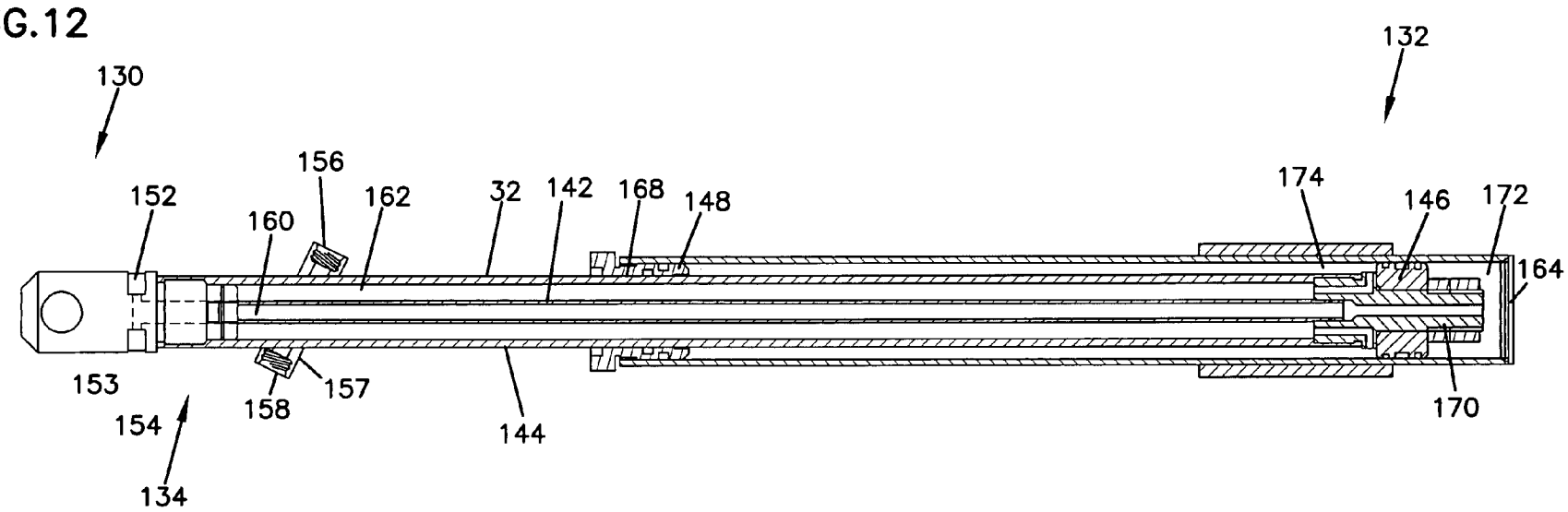
FIG. 12 is a sectional view of the lift cylinder shown in FIG. 1.
Figure 13:
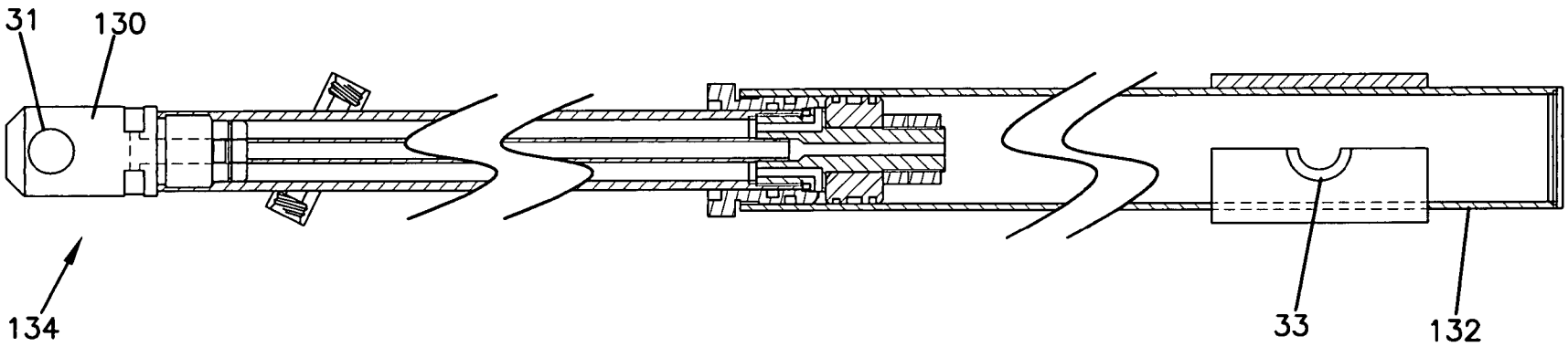
FIG. 13 is a sectional view of the left cylinder shown in FIG. 1.

Now referring to FIGS. 11–13, the lift cylinder is shown at reference number 32. It should be understood that the name "lift cylinder" is used because of the placement of the cylinder on the loader assembly 12 and its function to raise and loader the loader assembly 12. It should be understood that the lift cylinder 32 can be utilized for different applications other than raising or lowering a loader assembly. The name "lift cylinder" is used as a matter of convenience and does not limit how the cylinder is used. It should be understood that the lift cylinder 32 can be referred to as a first cylinder because it describes one of the hydraulic cylinder designs according to the invention.

The lift cylinder 32 is shown having a first end 130 and a second end 132. The first end 130 attaches to the loader arm 30 at the lift cylinder/loader arm rotation pin 31. The lift cylinder second end 132 attaches to the tower 28 at the lift cylinder/tower rotation pin 33. The applicants found that when the hydraulic lines are concealed within the front end loader 12, it is convenient to have the hydraulic lines ported to one end of the lift cylinder 32. The hydraulic lines are ported to the lift cylinder first end 130. The lift cylinder first end 130 can be referred to as the ported end 134.

Now referring to FIG. 11, an exploded view of the components of the lift cylinder is provided. The lift cylinder 32 includes a ported ram end 140, an inner tube 142, a ram tube 144, a piston 146, a gland 148, and a cylinder barrel 150. The ported ram end 140 includes an extension port 152 and an extension through port 154. The ram tube 144 includes a retraction port 156 and a retraction through port 158. As hydraulic fluid flows into the extension port 152, a portion of the hydraulic fluid flows out the extension through port 154 for powering the corresponding lift cylinder. Accordingly, the combination of the extension port 152 and the extension through port 154 is similar to a tee connection, and can be characterized as a first internal tee 153. The hydraulic fluid flows in the reverse direction as well in order for the hydraulic cylinder to operate. Similarly, the retraction port 156 and the retraction through port 158 can be characterized as a tee connection, and can be characterized as a second internal tee 157. The corresponding hydraulic cylinder can be constructed similarly to the lift cylinder 32 with the extension through port 154 and the retraction through port 158 plugged or capped. That is, when it is not necessary to power additional hydraulic cylinders, the identical hydraulic cylinder can be used except that the extension through port 154 and the retraction through port 158 can be plugged or capped because it is not necessary to continue hydraulic lines to another hydraulic cylinder. In addition, it should be understood that the hydraulic cylinder can be provided without an internal tee. That is, if a tee connection is desired, it can be provided exterior to the hydraulic cylinder. In this type of design, the hydraulic cylinder can include a single extension port and a single retraction port.

The ram tube 144 slides within the cylinder barrel 150. The inner tube 142 is provided within the ram tube 144 to provide an extension hydraulic fluid conduit 160 and a retraction hydraulic fluid conduit 162. Hydraulic fluid flowing into the extension port 152 flows through the extension hydraulic fluid conduit 160 provided within the inner tube 142. Hydraulic fluid flowing into the retraction port 156 flows through the retraction hydraulic fluid conduit 162 between the inner tube 142 and the ram tube 144.

The cylinder barrel 150 includes an end cap 164 at the second end 132. The cylinder barrel 150 includes the gland 148. The gland 148 includes a ram tube opening 168 that allows the ram tube 144 to slide there through. The ram tube 144 receives a ram end 170 that includes the piston 146. The ram end 170 is constructed to allow the hydraulic fluid flowing through the extension hydraulic fluid conduit 160 to fill the extension space 172 provided between the piston 146 and the end cap 164. In addition, the ram end 170 allows the hydraulic fluid flowing through the retraction hydraulic fluid conduit 162 to flow into the retraction space 174 provided between the piston 146 and the gland 148.

The piston 146 can include seal grooves 181 and 183 for containing seals that reduce flows of hydraulic fluid from the extension space 172 to the retraction space 174 by flowing between the piston 146 and the cylinder barrel 150. In addition, the gland 148 can include a seal groove 185 for containing a seal that helps reduce flow of hydraulic fluid from the retraction space 174 to the exterior by flowing between the gland 148 and the cylinder barrel 150.

Figure 14:
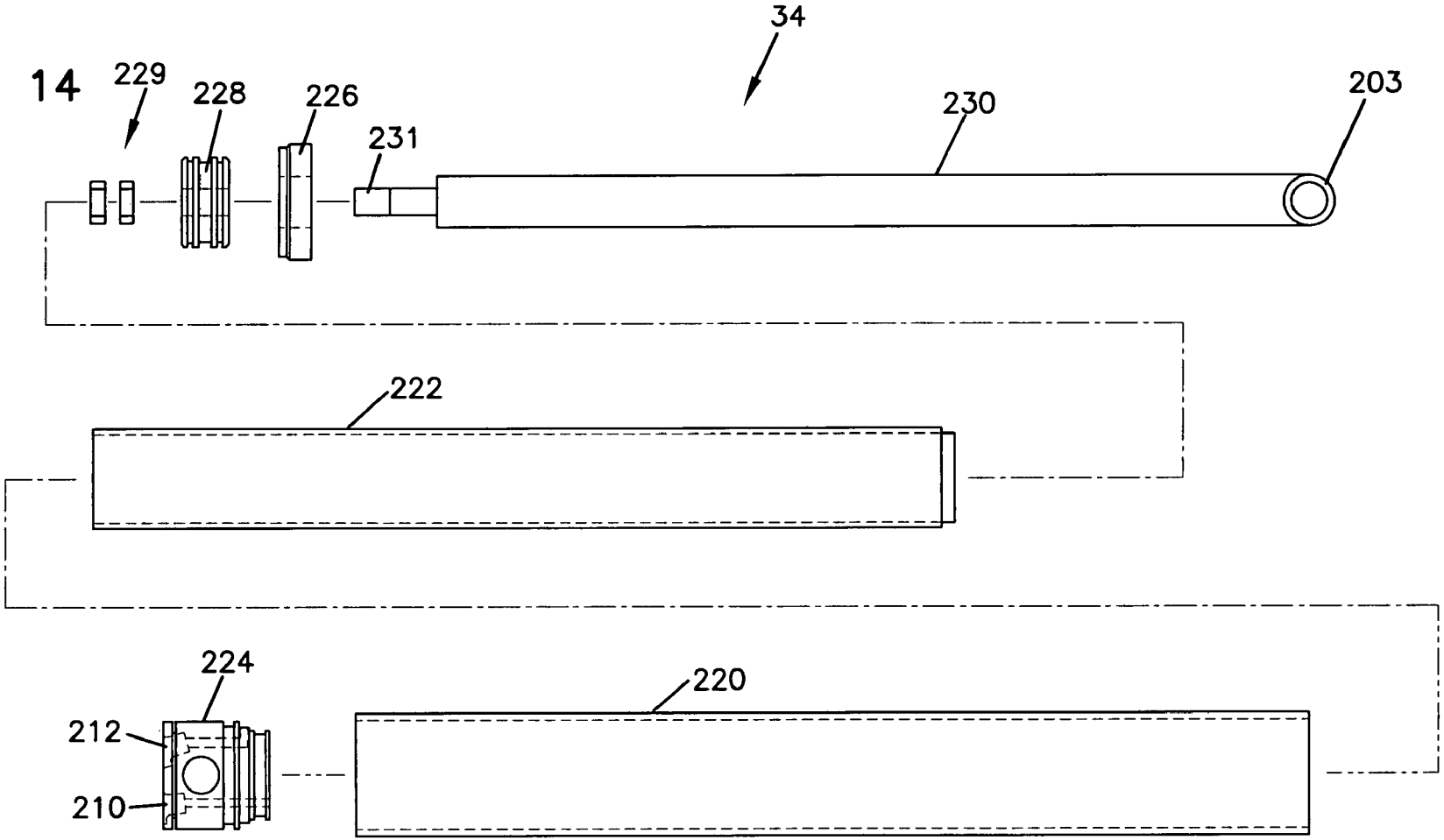
FIG. 14 is an assembly view of the attachment cylinder shown in FIG. 1.
Figure 15:
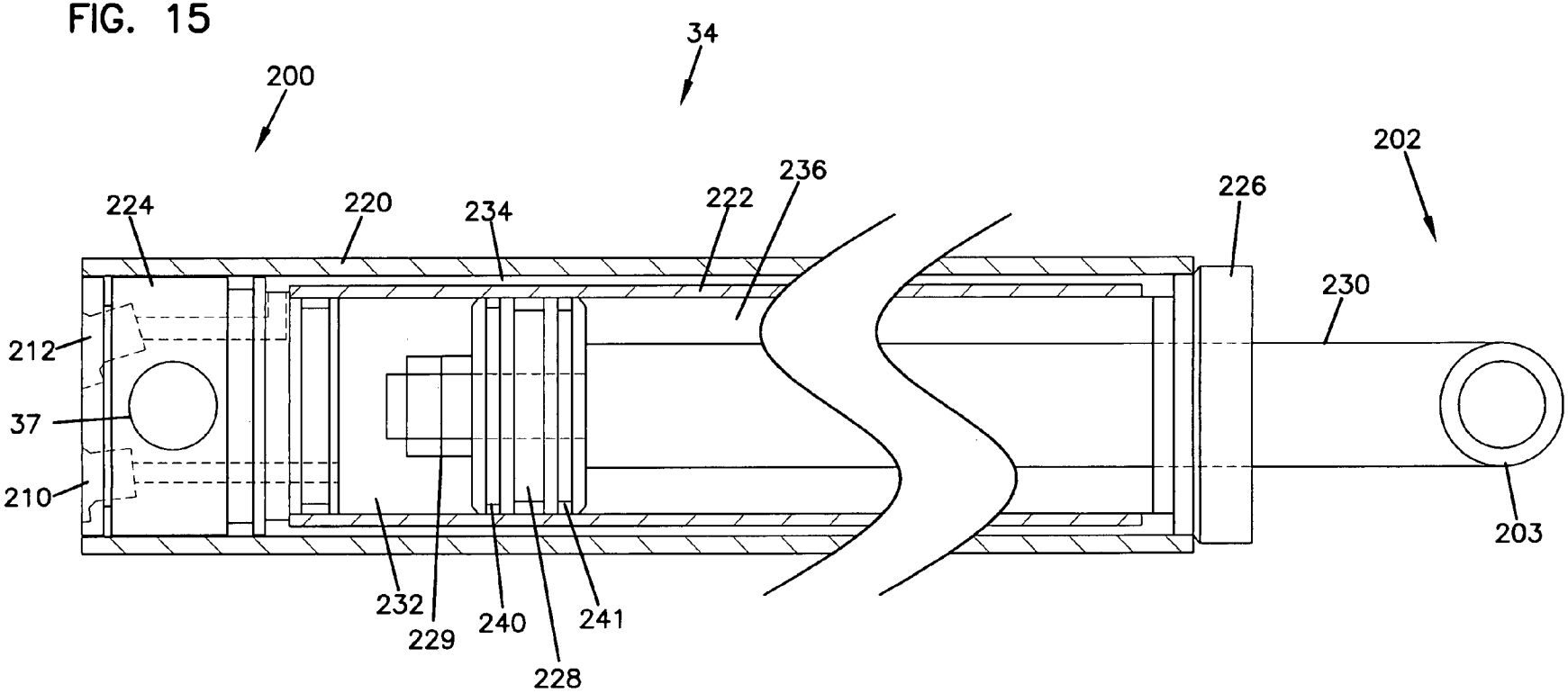
FIG. 15 is a sectional view of the attachment cylinder shown in FIG. 1.

Now referring to FIGS. 14 and 15, the construction of the attachment cylinder 34 is shown in detail. It should be understood that the name "attachment cylinder" is used as a matter of convenience because of the placement of the cylinder on the loader assembly 12 and because of its use in operating the attachment 16. The attachment cylinder 34 can be referred to as the second cylinder or as the cylinder, and can be used in other applications.

The attachment cylinder 34 includes a first end 200 and a second end 202. In order to conceal the hydraulic lines within the loader assembly 12, the first end 200 is ported and the second end 202 is non-ported. This means that the attachment cylinder 34 is operated by the flow of hydraulic fluid into and out of the first end 200. The first end 200 attaches to the lift arm 30 at the attachment cylinder/lift arm pin 37. The second end 202 includes a bushing 203 for attaching the attachment cylinder 34 to an attachment such as a bucket. The bushing 203 can attach to the attachment cylinder pin 205 as shown in FIG. 1.

The attachment cylinder 34 includes an extension port 210 and a retraction port 212. As hydraulic fluid flows into the extension port 210, the attachment cylinder 32 expands. As hydraulic fluid flows into the retraction port 212, the attachment cylinder 32 retracts. Although not shown in FIGS. 14 and 15, the ported end 200 can include tee connections for supplying the corresponding attachment cylinder. For example, the right attachment cylinder (not shown) can include an extension port, an extension through port, a retraction port, and a retraction through port similar to the lift cylinder 32. The purpose of the tee connection is to provide hydraulic fluid to the corresponding hydraulic cylinder. The left and right attachment cylinders can be identical except that the expansion through port and the retraction through port can be plugged or capped. Alternatively, tees can be provided outside of the attachment cylinder 34.

The attachment cylinder 34 includes an outer attachment cylinder barrel 220, an inner attachment cylinder barrel 222, a ported cylinder end cap 224, a gland 226, a piston 228, and a ram 230. Hydraulic fluid entering the extension port 210 passes through the ported cylinder end cap 224 and into the expansion space 232 provided between the ported cylinder end cap 224 and the piston 228. The hydraulic fluid that enters the retraction port 212 passes through the ported cylinder end cap 224, through the hydraulic fluid retraction conduit 234 between the outer attachment cylinder barrel 220 and the inner attachment cylinder barrel 222 to fill the retraction space 236 between the gland 226 and the piston 228.

The piston 228 can include seal grooves 240 and 241 that can contain seals to help reduce flow of hydraulic fluid between the expansion space 232 and the retraction space 236. In addition, seals can be provided in the cylinder end cap 224 and the gland 226 to provide seals reducing the flows of hydraulic fluid.

The ram 230 can be attached to the piston 228 and held in place by a nut assembly 229 that attaches to the neck 231 on the ram 230. It should be understood that various techniques can be provided for attaching the various components of the hydraulic cylinders. For example, welding and screw connections can be utilized. In addition, certain types of clips can be used to hold components together. Other fasteners that are known in the art can be used to hold components of the cylinders together.

Figure 16:
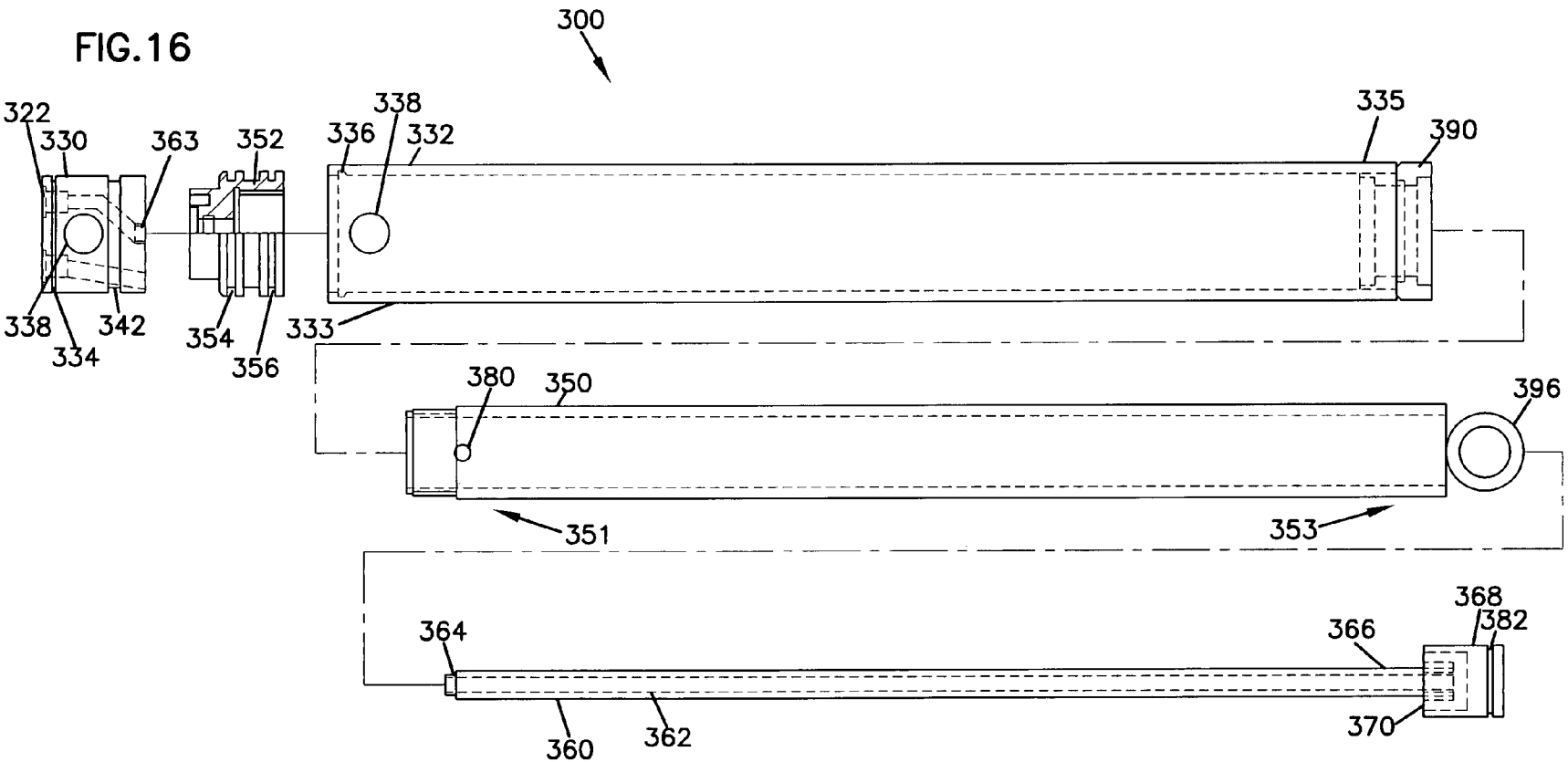
FIG. 16 is an assembly view of an alternative hydraulic cylinder according to the principles of the invention.
Figure 17:
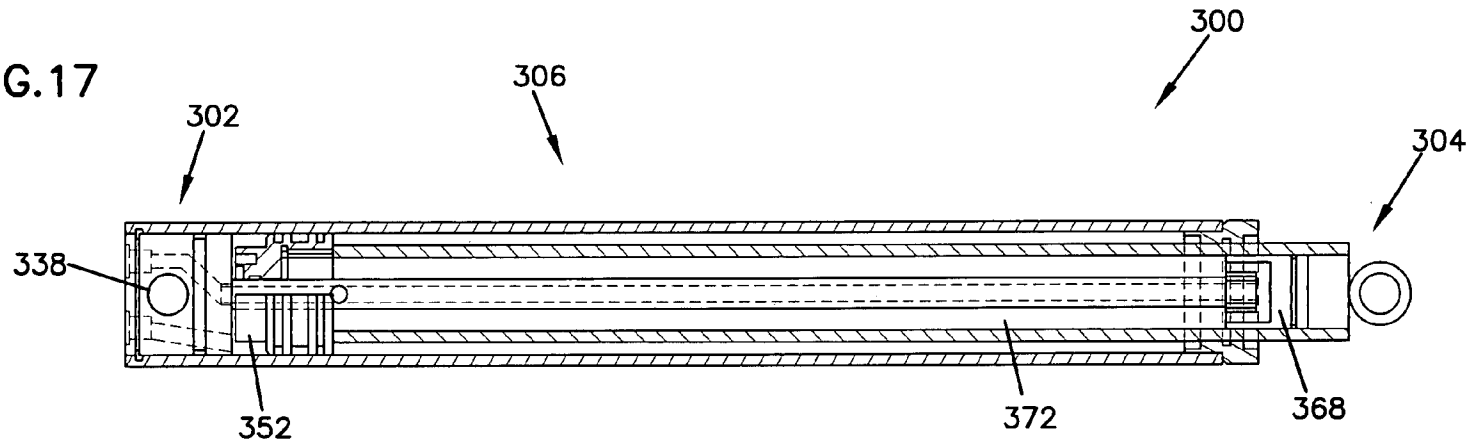
FIG. 17 is a sectional view of the hydraulic cylinder of FIG. 16 in a retracted position.
Figure 18:
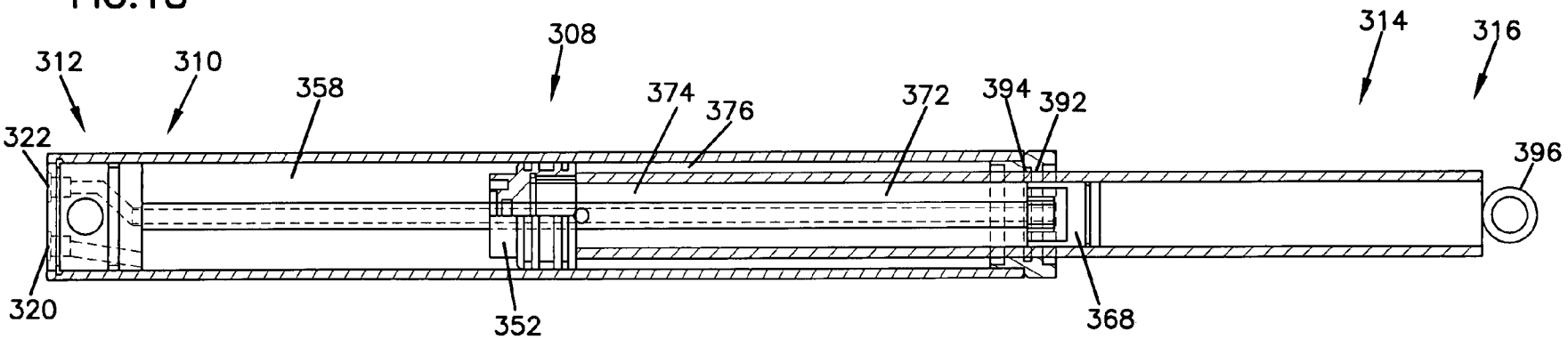
FIG. 18 is a sectional view of the hydraulic cylinder of FIG. 16 in a partially extended position.

Now referring to FIGS. 16-18, an alternative hydraulic cylinder is shown at reference number 300. The hydraulic cylinder 300 can be used as the lift cylinder and/or the attachment cylinder, and can be referred to as a single ported end hydraulic cylinder because of the presence of a ported end 302 and a non-ported end 304. The ported end 304 can be called the cylinder end and the non-ported end 308 can be called the ram end.

The hydraulic cylinder 300 is shown in a retracted position 306 in FIG. 17, and in a partially extended position 308 in FIG. 18. The hydraulic cylinder 300 provides a design that increases the amount of square inches of pressure surface relative to the hydraulic cylinders 32 and 34. By increasing the amount of square inches of pressure surface, the hydraulic cylinder 300 can provide increased power. The design that provides this increased power is apparent in view of the following discussion.

The hydraulic cylinder 300 includes a first end 310 that can be referred to as the ported end 312, and a second end 314 that can be referred to as the non-ported end 316. At the ported end 312, the hydraulic cylinder 300 includes an extension port 320 and a retraction port 322. As hydraulic fluid flows into the extension port 320, the hydraulic cylinder 300 expands. As hydraulic fluid flows into the retraction port 322, the hydraulic cylinder 300 retracts. The extension port 320 and the retraction port 322 are shown provided in a back cap 330. The back cap 330 is provided within the cylinder barrel 332. The cylinder barrel 332 includes a cylinder barrel first end 333 and a cylinder barrel second end 335. The back cap 330 can be provided within the cylinder barrel first end 333. The back cap 330 can be welded to the cylinder barrel 332 or it can be held in place by a snap ring that fits within the snap ring groove 334 on the back cap 330 and within the snap ring groove 336 provided in the cylinder barrel 332. When a snap ring is used to hold the back cap 330 to the cylinder barrel 332, a pin can be provided through the pin hole 338 in order to hold the back cap 330 and the cylinder barrel 332 together. In addition, a seal can be provided within the seal groove 342 to help reduce passage of hydraulic fluid between the back cap 330 and the cylinder barrel 332. Although the back cap 330 is shown having a single extension port 320 and a single retraction port 322, it should be understood that the back cap 330 can be designed to provide a tee connection in order to allow passage of hydraulic fluid there through for the operation of another hydraulic cylinder in parallel.

The hydraulic cylinder 300 includes a ram 350 and a large piston 352 that are attached together and slide within the cylinder barrel 332. The large piston 352 is shown in FIGS. 16-18 as a partial sectional view. The large piston 352 includes seal grooves 354 and 356 that reduce the movement of hydraulic fluid between the large piston 352 and the cylinder barrel 332. As hydraulic fluid flows through the extension port 320 and floods the extension space 358, the large piston 352 moves away from the back cap 330. The ram 350 includes a ram first end 351 and a ram second end 353. The large piston 352 can be attached to the ram first end 351 by any number of techniques including a screw connection, a weld, etc.

The hydraulic cylinder 300 includes a center line 360 having an internal conduit 362 that allows hydraulic fluid to flow therethrough. The center line 360 includes a first end 364 that attaches to the back cap 330 at the center line port 363. The center line first end 364 can be welded to the center line port 363. The center line 360 includes a second end 366 that includes a small piston 368 attached thereto. The small piston 368 can be attached to the center line second end 366 by any number of techniques including a screw connection, welding, etc. The small piston 368 includes a small piston retraction port 370. As hydraulic fluid flows into the retraction port 322, through the center line conduit 362, and out the small piston retraction port 370, the hydraulic fluid floods the retraction space 372 causing the hydraulic cylinder to retract. It should be understood that as hydraulic fluid flows into the retraction port 322, hydraulic fluid flows out of the extension port 320, and vice versa. In addition, the retraction space 372 includes a center line retraction space 374 and a ram retraction space 376. The center line retraction space 372 is the space provided between the center line 360 and the ram 350. The ram retraction space 376 is the area provided between the ram 350 and the cylinder barrel 332. The center line retraction space 374 and the ram retraction space 376 are provided in fluid communication as a result of the conduit 380 provided through the ram 350. The small piston 368 includes a seal groove 382 that reduces flow of hydraulic fluid between the small piston 368 and the ram 350. As hydraulic fluid flows into the retraction port 322, the ram 350 retracts so that the large piston 352 moves toward the back cap 330.

The hydraulic cylinder 300 includes a gland 390 attached to the cylinder barrel 332. The gland 390 can be welded to the cylinder barrel 332. The gland 390 includes an opening 392 through which the ram 350 can move. The gland 390 can include a seal groove 394 that reduces the flow of hydraulic fluid between the ram 350 and the gland 390. An end bushing 396 can be provided at the ram second end.

It is expected that the third hydraulic cylinder will provide greater power compared with the first hydraulic cylinder or the second hydraulic cylinder when the hydraulic cylinders are comparatively sized. For a hydraulic cylinder having a cylinder barrel having an inside diameter of 3 inches and a ram having an outside diameter of 1⅓ inches, 4.66 square inches is provided there between. For a hydraulic cylinder having a cylinder barrel having an inside diameter of 3 inches, and a ram having an outside diameter of 2¼ inches, 3.09 square inches is provided there between. By adding a center line inside of the ram having an 11/16 inch outer diameter and a 7/16 inch inner diameter, 5.126 square inches results. By applying equal hydraulic pressure, the hydraulic cylinder having a larger square inch surface area provides greater force.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A loader assembly comprising:

(a) a boom arm comprising:

(i) a tower comprising a plurality of first hydraulic fluid coupler members;

(ii) a lift arm that rotates relative to the tower about a tower/lift arm rotation pin;

(iii) at least one hydraulic cylinder; and (b) a bracket assembly comprising:

(i) a stationary bracket comprising a plurality of second hydraulic fluid coupler members, the stationary bracket being constructed for attachment to a motor vehicle and attachment to the tower to provide a fluid connection between the first coupler members and the second coupler members; and (ii) a rotating bracket that rotates relative to the stationary bracket about a bracket rotation pin, the rotating bracket being constructed to receive the tower and rotate the tower for attachment to the stationary bracket.

2. A loader assembly according to claim 1, wherein:

(a) the tower comprises an upper block having the plurality of first hydraulic fluid coupler members extending there through; and (b) the stationary bracket comprising a lower block having the plurality of second hydraulic fluid coupler members extending there through.

3. A loader assembly according to claim 2, wherein the upper block and the lower block each comprise a nesting surface having a three dimensional configuration that resists twisting when the upper block and the lower block nesting surfaces are nested together.

4. A loader assembly according to claim 2, wherein the upper block comprises a centering pin and the lower block comprises a centering pin hole for receipt of the centering pin.

5. A loader assembly according to claim 1, wherein the tower comprises a guide pin, and the rotating bracket comprises a guide pin slot for receipt of the guide pin.

6. A loader assembly according to claim 1, wherein said at least one hydraulic cylinder comprises a lift cylinder that rotates the lift arm relative to the tower, and an attachment cylinder that operates an attachment relative to the lift arm.

7. A loader assembly according to claim 6, wherein the boom arm comprises hydraulic lines that extend from the first hydraulic fluid coupler members to the lift cylinder.

8. A loader assembly according to claim 7, wherein the hydraulic lines are concealed within the tower and the lift arm.

9. A loader assembly according to claim 6, wherein the boom arm comprises hydraulic lines that extend from the first hydraulic fluid coupler members to the attachment cylinder.

10. A loader assembly according to claim 9, wherein the hydraulic lines are concealed within the tower and the lift arm.

11. A loader assembly according to claim 1, wherein the boom arm comprises a loader stand that is constructed to extend from the loader arm for holding the loader assembly in a storage position.

12. A loader assembly according to claim 11, wherein the boom arm comprises a cable for releasing the loader stand from the boom arm so that the loader stand can move to the storage position.

13. A loader assembly according to claim 1, wherein the loader assembly further comprises:

(a) a corresponding boom arm comprising:

(i) a corresponding tower comprising a plurality of corresponding tower first hydraulic fluid coupler members;

(ii) a corresponding lift arm that rotates relative to the corresponding tower about a second tower/lift arm rotating pin;

(iii) at least one corresponding hydraulic cylinder; and (b) a corresponding bracket assembly comprising:

(i) a corresponding stationary bracket comprising a plurality of corresponding stationary bracket second hydraulic fluid coupler members, the corresponding stationary bracket being constructed for attachment to a motor vehicle and attachment to the corresponding tower to provide a fluid connection between the corresponding tower first hydraulic fluid coupler members and the corresponding stationary bracket second coupler members; and (ii) a corresponding rotating bracket that rotates relative to the corresponding stationary bracket about a corresponding bracket rotation pin, the corresponding rotating bracket being constructed to receive the corresponding tower and rotate the corresponding tower for attachment to the corresponding stationary bracket.

14. A loader assembly according to claim 13, wherein the loader assembly further comprises a stabilizing arm extending between the lift arm and the corresponding lift arm.

15. A loader assembly according to claim 14, wherein the loader assembly further comprises hydraulic lines extending through the tower and the lift arm, and hydraulic lines extending through the corresponding tower and the corresponding lift arm, and hydraulic lines extending through the stabilizing arm.

16. A combination motor vehicle and loader assembly comprising:

a motor vehicle having a forward end; and a loader assembly attached to the motor vehicle forward end comprising:

(a) a boom arm comprising:

(i) a tower comprising a plurality of first hydraulic fluid coupler members;

(ii) a lift arm that rotates relative to the tower about a tower/lift arm rotating pin;

(iii) at least one hydraulic cylinder; and (b) a bracket assembly comprising:

(i) a stationary bracket attached to the motor vehicle forward end, the stationary bracket comprising a plurality of second hydraulic fluid coupler members attached to the first hydraulic fluid coupler members and providing fluid connection between the first hydraulic fluid coupler members and the second hydraulic fluid coupler members; and (ii) a rotating bracket that rotates relative to the stationary bracket about a bracket rotation pin, the rotating bracket being constructed to receive the tower and rotate the tower for attachment to the stationary bracket.

17. A combination motor vehicle and loader assembly according to claim 16, wherein the motor vehicle comprises a tractor.

18. A method for attaching a loader assembly to motor vehicle, the method comprising:

providing a loader assembly in a storage position, wherein the loader assembly comprising:

(a) a boom arm comprising:

(i) a tower comprising a plurality of first hydraulic fluid coupler members;

(ii) a lift arm that rotates relative to the tower about a tower/lift arm rotating pin;

(iii) at least one hydraulic cylinder; and (b) a bracket assembly comprising:

(i) a stationary bracket comprising a plurality of second hydraulic fluid coupler members, the stationary bracket being constructed for attachment to a motor vehicle and attachment to the tower to provide a fluid connection between the first coupler members and the second coupler members; and (ii) a rotating bracket that rotates relative to the stationary bracket about a bracket rotation pin, the rotating bracket being constructed to receive the tower and rotate the tower for attachment to the stationary bracket; and moving the motor vehicle forward so that the tower contacts the rotating bracket.

19. A method according to claim 18, further comprising attaching the plurality of first hydraulic fluid coupler members to the plurality of second hydraulic fluid coupler members to provide a fluid connection between the plurality of first hydraulic fluid coupler members and the plurality of second hydraulic fluid coupler members.

20. A method according to claim 18, further comprising a step of locking the tower to the stationary bracket.

21. A method according to claim 18, further comprising providing an attachment attached to the lift arm wherein said at least one hydraulic cylinder comprises an attachment cylinder that attaches to the lift arm and the attachment, and operating the attachment cylinder to move a stand attached to the lift arm from a storage position to a working position.

22. A loader assembly comprising:

(a) a left boom arm comprising a left tower, a left lift arm constructed to rotate relative to the left tower about a left tower/left lift arm rotation pin, a left lift cylinder attached to the left tower and the left lift arm to cause the left lift arm to rotate relative to the left tower;

(b) a right boom arm comprising a right tower, a right lift arm constructed to rotate relative to the right tower about a right tower/right lift arm rotation pin, a right lift cylinder attached to the right tower and the right lift arm to cause the right lift arm to rotate relative to the right tower;

(c) at least one stabilizing arm extending between the left lift arm and the right lift arm, and comprising an interior region; and (d) hydraulic lines extending through the interior region of the stabilizing arm.

23. A loader assembly according to claim 22, wherein the left boom arm comprises a left attachment cylinder attached to the left lift arm and constructed to attach to an attachment, and the right boom arm comprises a right attachment cylinder attached to the right lift arm and constructed to attach to an attachment, and wherein the hydraulic lines extending through the stabilizing arm are provided for powering the left attachment cylinder and the right attachment cylinder.

24. A loader assembly according to claim 22, wherein the hydraulic lines extending through the stabilizing arm are provided for powering the left lift cylinder and the right lift cylinder.

25. A loader assembly according to claim 22, wherein the left lift arm comprises an interior region and the right lift arm comprises an interior region, and wherein the hydraulic lines extending through the interior region of the stabilizing arm extend through the interior region of the left lift arm and the interior region of the right lift arm.

* * * * *